US007282072B2

(12) United States Patent
Taulbee

(10) Patent No.: US 7,282,072 B2
(45) Date of Patent: Oct. 16, 2007

(54) SYNTHETIC FUEL AND METHODS FOR PRODUCING SYNTHETIC FUEL

(75) Inventor: Darrell M. Taulbee, Frankfort, KY (US)

(73) Assignee: University of Kentucky Research Foundation, Lexington, KY (US)

( * ) Notice: Subject to any disclaimer, the term of this patent is extended or adjusted under 35 U.S.C. 154(b) by 0 days.

(21) Appl. No.: 09/793,662

(22) Filed: Feb. 26, 2001

(65) Prior Publication Data

US 2002/0050094 A1 May 2, 2002

Related U.S. Application Data

(60) Provisional application No. 60/191,911, filed on Mar. 24, 2000, provisional application No. 60/185,144, filed on Feb. 25, 2000.

(51) Int. Cl.
*C10L 1/12* (2006.01)
*C10L 5/00* (2006.01)
*C10L 5/02* (2006.01)

(52) U.S. Cl. ..... 44/457; 44/500; 44/580; 44/603

(58) Field of Classification Search ..... 44/457, 44/301, 500, 580, 603
See application file for complete search history.

(56) References Cited

U.S. PATENT DOCUMENTS 3,725,034 A 4/1973 Joseph et al.
3,730,692 A * 5/1973 Holowaty ..... 44/591
4,040,797 A * 8/1977 Young ..... 44/321
4,152,119 A 5/1979 Schulz
4,219,519 A 8/1980 Goksel
4,230,460 A 10/1980 Maust, Jr.
4,369,054 A 1/1983 Shinholster, Jr. et al.
4,698,067 A 10/1987 Finley et al.
4,741,278 A * 5/1988 Franke et al. ..... 110/342
4,758,244 A * 7/1988 Harvey et al. ..... 44/608
4,863,485 A 9/1989 Schaffer et al.
5,009,671 A 4/1991 Franke et al.
5,264,007 A 11/1993 Lask
5,487,762 A * 1/1996 Sinha ..... 44/363
5,505,746 A * 4/1996 Chriswell et al. ..... 44/624
5,512,265 A * 4/1996 Funahashi et al. ..... 423/640
5,562,743 A * 10/1996 Daugherty ..... 44/589
5,589,118 A 12/1996 Ford, Jr. et al.
5,738,694 A 4/1998 Ford, Jr. et al.
5,743,924 A 4/1998 Dospoy et al.
5,823,758 A * 10/1998 Lack ..... 431/4
5,916,826 A 6/1999 White
5,951,722 A * 9/1999 Sanders ..... 44/354
6,013,116 A 1/2000 Major et al.
6,036,881 A * 3/2000 Hurst ..... 252/192

FOREIGN PATENT DOCUMENTS

EP 566419 * 10/1993
GB 2 181 449 4/1987

* cited by examiner

*Primary Examiner*—Cephia D. Toomer
(74) *Attorney, Agent, or Firm*—King & Schickli, PLLC

(57) ABSTRACT

The present invention provides synthetic fuels, additives for use in preparing synthetic fuels and methods for producing synthetic fuel. The synthetic fuels include low levels of a chemical change additive selected from the group consisting of alkaline earth oxides and hydroxides and mixtures thereof. In one embodiment, the synthetic fuel further includes low levels of a second chemical change additive, which is a petroleum hydrocarbon material.

12 Claims, 14 Drawing Sheets

FT-i.r. spectra showing changes in hydrogen bonding in synthetic fuel following reaction. All spectra normalized and plotted to same Y-scale. Spectra of additives are offset from baseline for clarity.

FT-i.r. spectra showing changes in hydrogen bonding in synthetic fuel following reaction. All spectra normalized and plotted to same Y-scale. Spectra of additives are offset from baseline for clarity.

FT-i.r. spectra showing changes in chemical bonding between 1,100-1,500 cm-1 following reaction. All spectral normalized and plotted to same Y-scale. Spectra of additives are offset from baseline for clarity.

FT-i.r. spectra showing changes in hydrogen bonding in synfuel following reaction. All spectral normalized and plotted to same Y-scale. Spectra of additives and asphalt are offset from baseline for clarity.

FT-i.r. spectra showing increase in absorption band at ~1,440 cm-1 in synfuel following reaction. All spectral normalized and plotted to same Y-scale. Spectra of additives and asphalt are offset from baseline for clarity.

FT-i.r. spectra showing newly formed bond absorbing at ~875cm−1 in synfuel following reaction. All spectral normalized and plotted to same Y-scale. Spectra of additives and asphalt are offset from baseline for clarity.

Averaged FT-I.r. spectra showing newly-formed absorption band near 875 cm−1. All spectra are normalized to 1 mg and plotted to same Y-scale. Combined spectrum is digital combination of starting components.

Averaged FT-I.r. spectra showing change in the 1,440/1,600 cm-1 band ratios. All spectra are normalized to 1 mg and plotted to same Y-scale. Spectra were vertically alligned at ~1,600 cm-1 for clarity.

FT-I.r. spectra showing an increase in H-bonding in synfuel and control blend samples. All spectra are normalized to 1 mg and plotted to same Y-scale. Combined spectrum is digital combination of starting components.

Average FT-I.r. spectra showing newly-formed absorption band near 875 cm-1. All spectra are normalized to 1 mg and plotted to same Y-scale. Combined spectrum is digital combingation of starting components.

Average FT-I.r. spectra showing change in the 1,440/1,600 absorption band ratios. All spectra are normalized to 1 mg and plotted to same Y-scale. Spectra are shown vertically alligned at ~1600 cm-1 for clarity.

Average FT-I.r. spectra showing increase in H-bonding in synfuel and control blend. All spectra are normalized to 1 mg and plotted to same Y-scale. Combined spectrum is digital combination of starting components.

Average FT-I.r. spectra showing newly formed absorption band near 870 cm-1. All spectra are normalized to 1 mg and plotted to same Y-scale.

FT−I.r. spectra showing the changes in absorption near 1,440 cm−1. All spectra are normalized to 1 mg and plotted to same Y−scale. Spectra were vertically alligned at ~1,600 cm−1 for clarity.

FT-I.r. spectra showing the changes in H-bonding near 3,440 cm-1. All spectra are normalized to 1 mg and plotted to same Y-scale.

SYNTHETIC FUEL AND METHODS FOR PRODUCING SYNTHETIC FUEL

This application claims the benefit of U.S. Provisional Application No. 60/185,144, filed Feb. 25, 2000 and by U.S. Provisional Application No. 60/191,911, filed Mar. 24, 2000.

FIELD OF THE INVENTION

The present invention relates generally to fuel additives and more specifically to the production of synthetic fuel having a demonstrable chemical change.

BACKGROUND OF THE INVENTION

There are many environmental challenges associated with the production of power by combustion. The mere acts of mining and transporting coal to the coal-fired power plants results in the generation of tons of coal fines (fugitive particles of coal dust). For the most part, these fines are not directly usable, and therefore large quantities of material are wasted and represent a environmental hazard and expensive disposal problem. Typically, coal fines are disposed of at or near the mine site in unsightly piles, trenches, or ponds. Currently, there are over two billion tons of discarded coal fines throughout the United States. While a portion of coal fines can be combined with coarser fractions of mine production for sale, the inclusion of fines often reduces the quality of the product below market requirements. Accordingly, coal fines handling, storage and disposal operations represent a significant and unproductive expense for the industry.

One approach to addressing the problem of coal waste is to form the fines into briquettes, which can be transported to power plants easily and once there, utilized efficiently. In the recent past, briquetting was thought to be the most desirable way to handle coal fines. Regrettably, power plants that used briquetted coal fines have had many handling problems associated with attempts to burn these products. These problems have been attributed to the methods of briquet manufacturing.

Generally, briquets are formed in two ways; either with a large amount of hydrocarbon or inorganic binder. Typically, in the case of hydrocarbon binders, asphalt cement or asphalt emulsions are mixed with the waste coal fines at levels above 5 percent by weight of the coal fines and then compressed into pellets or briquets. Power plants that utilize these briquets find buildup due to sticking of asphalt and coal fines on coal conveying equipment. Sticking in the bottom cone portion of the silo is a particular problem because it reduces fuel flow from the silo, which results in additional maintenance and reduced fuel flow. From the silo, the coal is passed through a size reduction mill to produce coal dust, which is then typically pneumatically conveyed to the burner nozzle. Because of the increased temperature in the mill, the asphalt becomes sticky, and briquets that are bound with hydrocarbon take on a taffy consistency rather than being reduced to powder. The result is reduced fuel flow through the mill and less fuel reaching the burner.

A second way to briquet is to use an inorganic binder, such as lime (calcium oxide or calcium hydroxide) or portland cement. These inorganic binders are normally added at concentrations of about 5 percent to 10 percent by weight of the coal fines. One problem with these binders is that they significantly reduce the heating value of the coal and increase the ash of the coal. This increases the loading on the pollution control equipment resulting in the increased risk of exceeding air pollution limits. Additionally, the ash fusion temperature of the coal is significantly reduced leading to a tendency to form slag around the burner. The production of slag in this manner increases burner maintenance and, in severe cases, leads to the burner being shut down completely so the slag can be removed. Finally, the practice of adding lime and cement binders in a dry state to coal can result in a exothermic reaction, which causes the coal to ignite after the briquets are placed in storage. Such storage pile fires are a safety and environmental concern as well as a waste of fuel material. Due to power plant burner fouling and transportation difficulties, briquetted coal fines are now considered a less desirable alternative fuel for power plants.

In spite of the issues surrounding the use of coal fine briquettes, recent changes in the law provide incentives for converting coal waste into synthetic fuel. To encourage the use of other fuels and to encourage the cleanup of fugitive coal fines and other high BTU matter that can be used as fuel, Section 29 of the IRS Tax Code provides tax credits for synthetic fuels produced from coal, municipal waste or biomass in a synthetic fuel plant. A significant tax credit is given to synthetic fuel plants based on the amount of synthetic fuel they utilize and its heating value. The code provisions were enacted to provide incentives to recover waste coal fines currently stored in holding ponds around the country, to recover the heating value from the voluminous amounts of municipal waste generated annually, to provide an incentive to substitute biomass for coal, petroleum and natural gas during the generation of electricity, and to reduce reliance on foreign fuel sources. Synthetic fuel plants that qualify for this tax credit can produce fuel for lower prices. Power plants can then purchase this inexpensive synthetic fuel and thereby not utilize natural resources and have an incentive to substitute coal, biomass, or municipal waste for imported petroleum and natural gas.

Synthetic fuel is combustible material that has undergone "chemical change." This chemical change is generally determined utilizing chemical analysis equipment. Infrared spectroscopy (FTIR) is the method of choice for identifying changes in the molecular bonding or organic matrices such as those of combustible. In simple terms, absorption of infrared radiation occurs when the frequency of vibration of two atoms that are bound together by covalent or hydrogen bonding corresponds to the frequency of the radiation with which the sample is irradiated. The frequency at which a pair of bonded atoms oscillate is governed primarily by the identity of the atoms and, to a lesser extent, by their bonding environment, i.e., neighboring atoms or groups to which they are attached. Thus, an infrared spectrum can provide precise qualitative and semi-quantitative information on the nature of the molecular bonding within a given sample. Further, since infrared radiation is absorbed only by molecular bonds as opposed to individual atoms, changes in such absorption can be attributed to alterations in the molecular structure. This method is particularly sensitive to absorption by organic components and is useful for many inorganic components, though, in general, the sensitivity is not as great for the latter.

Of course, utilizing synthetic fuel and obtaining a tax credit cannot be counterproductive for power plants, or the plants will not be motivated to take steps to seek the tax credit. Therefore, obtaining and utilizing synthetic fuel is just the beginning of a power plant's fiscal concerns. In order to run efficiently, the power plant coal burner must utilize coal crushed to a uniform size and maintain a constant temperature. If the coal burner temperature is too low, slag will form in the burner. Slag periodically needs to be cleaned out of the burner causing the burner to be shut down during the cleaning procedure. The more slag that is produced, the more down time a coal burner will have. The ultimate goal in coal-fired power plants is to maintain a constant throughput of coal while maintaining a constant temperature, thereby producing power in the most efficient manner. Inefficient burning or down time because of increased slag causes the coal plant operators to utilize more natural resources in the form of coal to produce energy than would be necessary if the coal-fired plant was burning coal efficiently.

Of course, even when burning efficiently, coal-producing power plants are notorious for the environmental pollutants they produce. The burning of coal produces Priority Air Pollutants. These compounds include particulate matter, $NO_x$, and $SO_x$. Typically, most of these compounds are reduced from the stack emissions of the coal power plant by downstream and upstream environmental techniques. These techniques include the use of baghouses to trap particulate matter or scrubbers to trap $SO_x$, $NO_x$. Upstream techniques include the desulfurization of coal or using low-sulfur content coal as a fuel source.

Along with utilizing synthetic fuel to gain the direct economic benefit of a tax credit, it is certainly a goal of power plants to increase efficiency by reducing burner down time and to decrease costs associated with pollutant emissions. Generally, through a type of market control program under the Clean Air Act, power plants pay to emit pollutants. Typically, pollution credits are purchased yearly at a market price. If the owner does not use their credits, it can then sell them, usually for a profit. This type of market control makes it economically beneficial for power plants to reduce emissions.

Lastly, of extreme importance to power plants, is the BTU value of the fuel. This is the amount of energy that can be generated upon combustion. If the incoming fuel is too low in BTU value, the burner's throughput will be increased proportionally and burner down time will be more frequent. This concern, along with lowering emissions, and decreasing down time, creates a challenge to provide synthetic fuel for power plants. Certainly, it is in the best interest of power plants to utilize synfuel in order to obtain the immediate benefit of discounted fuel costs. If the synfuel also increased efficiency by lowering down time and burning to complete combustion while also lowering the production of priority air pollutants, the cost of producing power would decrease substantially.

Currently, a limited number of materials are being used for synthetic fuel production, none of which are completely effective. Examples include asphalt or asphalt emulsions, latex chemicals, and a proprietary polymeric material. Asphalt has been a more commonly used additive and provides a chemical change in the fuel product via the formation of hydrogen bonds between the asphalt and coal particles. However, this material suffers from several drawbacks: (1) the requirement that a much as 5 percent by-weight must be added in order to induce a consistent measurable change, so it is a costly additive; (2) the required chemical interaction does not occur with all coals, so it cannot be relied upon; and (3) the end-users, generally utility companies, encounter difficulties with crushing the synthetic fuel due to the high level of asphalt, which tends to clog the milling equipment, as discussed above, causing the fuel flow to decrease thereby reducing energy output. Market forces driven by the latter disadvantage results in a substantial discount in price for the sale of synthetic fuels produced with this level of asphalt. The high cost of this level of asphalt addition is also a major expense in the synthetic fuel production.

The second additive, polymeric precursors, suffers from an inability to consistently induce the prerequisite chemical change. The cost of polymeric precursors is a significant economic deterrent.

The prior art in the field of fuel additives for power plants has focused primarily on binding coal fines into strong, high BTU briquettes. Polymeric precursors and asphalt were often selected as binders because they have excellent binding characteristics and do not lower BTU value of the fuel. Because binding the coal particles together was the goal of this technology, the focus has been on providing a strong briquette with a high BTU value. These two parameters often necessitated the use of organic compounds because of there high BTU C—H bonds. However, the drawback of using organic compounds have been discussed above. Moreover, the organic compounds must be used in high amounts to bind coal, and at these high levels produce significant process handling problems for the power plant due to sticking buildup and fuel flow problems.

Much of the prior art uses varying levels of inorganic and organic compounds to form briquettes. For example, UK Patent GB 2181449 by Billcliffe et al. discloses the use of carbon dioxide, and either calcium oxide or calcium hydroxide at high levels in combination with a combustible material such as coal. U.S. Pat. No. 4,219,519 to Goksel discloses the use of calcium oxide or calcium hydroxide and silica to form briquettes from carbonaceous fines. Adding lime, limestone or dolomite and fly ash to finely divided coal as a binder to form durable pellets and agglomerates from finely divided coal is disclosed in U.S. Pat. No. 4,230,460 to Moss. U.S. Pat. No. 4,863,485 to Shaffer describes the use of polyvinyl alcohol and calcium oxide or magnesium oxide and water to form briquettes out of fine coal. U.S. Pat. No. 5,264,007 to Lask discloses the use, by way of example, of a lime and finely divided coke pitch to bind coal.

Each of these approaches employs high levels of inorganic lime, calcium hydroxide, or magnesium oxide. It is clear that the use of high levels of these compounds in fuel lowers ash fusion temperatures. The lower ash fusion temperature results in slag build up that ultimately requires the more frequent fuel burner maintenance and, in extreme cases, can result in such a large buildup that the burner needs to be shut down for cleaning. This can result in a utility not meeting its electric demand requiring the purchase of electricity from other utilities. This is an expensive risk for power plants when one considers that during these days of utility deregulation the power plant operator will be forced to purchase power for its customers at high market rates. Moreover, the cost of additives are prohibitively expensive. Additionally, the high lime concentration reduces heating value and the resulting ash increases the loading on air pollution equipment. In the first instance the use of high levels of inorganic compounds in the synthetic fuel causes burners to be taken off line more frequently. In a second instance, the use of expensive inorganics and organics as binders that do not reduce fusion temperature is cost prohibitive.

U.S. Pat. No. 6,013,116 to Major et al. is directed towards inducing a chemical alteration in synthetic fuel in order to qualify for IRS Section 29 tax credits. However, Major et al. is primarily focused on utilizing a binder for improved structural integrity in fuel briquettes or pellets. Further, this invention relies primarily upon lignosulfonate as a binder.

Lignosulfonate is a relatively inexpensive waste product of the paper-making industry. It generally has a high BTU value but since it adds sulfur to the fuel, its use results in higher $SO_x$ emissions and the resulting need to purchase, rather than sell, priority air pollutant credits.

As the above has illustrated, the prior art utilizes additives at such high levels that the economic benefit of any foreseeable tax credit given for using synthetic fuel would be lost due to other inefficiencies and costs. As a result, the prior art does not solve the problem of providing a high BTU synthetic fuel that has consistently verifiable chemical change, thereby allowing the economic advantage of a tax credit while at the same time lowering pollution emissions without reducing power generation rate from the electric utility.

SUMMARY OF THE INVENTION

In accordance with the present invention, a method for preparing synthetic fuel is provided. The method comprises mixing a chemical change additive with a solid fuel material to produce synthetic fuel. The additive is present in an amount of less than about 1 percent by-weight of the synthetic fuel and is selected from the group consisting of alkaline earth oxides, alkaline earth hydroxides and mixtures thereof. In a specific embodiment, the chemical change additive is calcium oxide, calcium hydroxide magnesium oxide, magnesium hydroxide, oxides of dolomite, hydroxides of dolomite or mixtures thereof.

In some embodiments of this invention, the solid fuel material is a waster material, such as coal fines. In other embodiments, the solid fuel material can is coal, or a mixture of coal and up to 60 percent of biomass In a particular embodiment, the chemical change additive is present in an amount between about 0.1 percent and about 1.0 percent by-weight of the synthetic fuel. In some cases, the preferred amount of chemical change additive is between about 0.20 percent and about 0.75 percent by-weight of the synthetic fuel. In still other embodiments, the additive is present in an amount between about 0.3 percent and about 0.4 percent. In one particular embodiment, the additive is present at about 0.375 percent by weight of the synthetic fuel product.

In a particular embodiment, the chemical change additive includes about 75 to 95 percent water. In yet another embodiment, the chemical change additive is sprayed onto the solid fuel material. Preferably, the resulting synthetic fuel is allowed to cure at ambient pressure and temperature. In a related embodiment, the synthetic fuel is exposed to carbon dioxide to enhance the chemical reaction.

In another embodiment, the method includes adding a second chemical change additive, such as petroleum hydrocarbon, such as, asphalt, tall oil, molasses, or other combustible liquid hydrocarbon, emulsifications thereof and combinations thereof into the blending system. In a related embodiment, the petroleum hydrocarbon is in an amount of less than about 3.0 percent by-weight of the synthetic fuel. In another related embodiment, the petroleum hydrocarbon is in an amount between approximately 0.5 and 1.5 percent by-weight of the synthetic fuel.

In another aspect, a synthetic fuel composition is provided comprising solid fuel material and a chemical change additive present in an amount of less than about 1 percent by-weight of the synthetic fuel composition and selected from the group consisting of alkaline earth oxides, alkaline earth hydroxides and mixtures thereof. In a particular embodiment, the additive is present in an amount between about 0.1 percent and about 1.0 percent. In a preferred embodiment the amount is between about 0.2 percent and about 0.75 percent. In some embodiments, the compositions include water and/or carbon dioxide. The chemical change additives include calcium oxide, calcium hydroxide magnesium oxide, magnesium hydroxide, oxides of dolomite, hydroxides of dolomite or mixtures thereof. The solid fuel materials include petroleum hydrocarbon, such as, asphalt, tall oil, molasses, or other combustible liquid hydrocarbon, emulsifications thereof and combinations thereof.

Another aspect of the invention is a method for preparing synthetic fuel, comprising mixing a chemical change additive with a combustible material to produce synthetic fuel. The additive is present in an amount of less than about 1 percent by-weight of the synthetic fuel and is selected from the group consisting of alkaline earth oxides, alkaline earth hydroxides and mixtures thereof.

In accordance with another aspect of the invention, a synthetic fuel composition is provided. The composition includes a combustible material and a chemical change additive present in an amount of less than about 1 percent by-weight of the synthetic fuel composition and is selected from the group consisting of alkaline earth oxides, alkaline earth hydroxides and mixtures thereof.

In another aspect of the invention, a composition for use in converting solid fuel products to synthetic fuel is provided. The composition consists essentially of a 25 percent by-weight aqueous solution of a chemical change additive selected from the group consisting of alkaline earth oxides, alkaline earth hydroxides or mixtures thereof.

A further aspect of the invention includes a composition for use in converting solid fuel products to synthetic fuel. The composition consisting essentially of a 25 percent by weight aqueous solution of a chemical change additive selected from the group consisting of alkaline earth oxides, alkaline earth hydroxides or mixtures thereof, and 40 percent by weight organic compound selected from the group consisting of petroleum hydrocarbon, such as, asphalt, or tall oil, molasses, or other combustible liquid hydrocarbon, emulsifications thereof and combinations thereof.

Another aspect of the invention includes a composition for use in converting solid fuel products to synthetic fuel. Such composition consists essentially of one part by weight chemical change additive selected from the group consisting of alkaline earth oxides, alkaline earth hydroxides or mixtures thereof; and between about 3 parts and about 20 parts by weight water. In a particular embodiment the composition also includes 2 parts organic compound which is petroleum hydrocarbon, such as, asphalt, or tall oil, molasses, or other combustible liquid hydrocarbon, emulsifications thereof and combinations thereof.

A further aspect of the invention includes a composition for use in converting solid fuel products to synthetic fuel. The composition consists essentially of one part by weight chemical change additive selected from the group consisting of alkaline earth oxides, alkaline earth hydroxides or mixtures thereof; between about 3 parts and about 20 parts by weight water, and about 2 parts organic compound selected from the group consisting of asphalt, tall oil, molasses, liquid hydrocarbon, emulsifications thereof and combinations thereof.

One object of the invention is to provide a synthetic fuel that when used by power plants increases the efficiency of power production, and at the same time reduces air pollutant emissions.

A further object of this invention is to provide a synthetic fuel that will burn at temperatures high enough to avoid the build up of slag in the burner that ultimately leads to the increased maintenance time associated with the use of prior synthetic fuels.

Another object of the invention is to provide a synthetic fuel and a method for its production that is cost efficient.

Another object of the invention is to provide a method for producing a synthetic fuel that uses a chemical change additive that work with all coals and will result in a consistent and independently verifiable chemical change.

DESCRIPTION OF THE PREFERRED EMBODIMENTS

Figure 1:
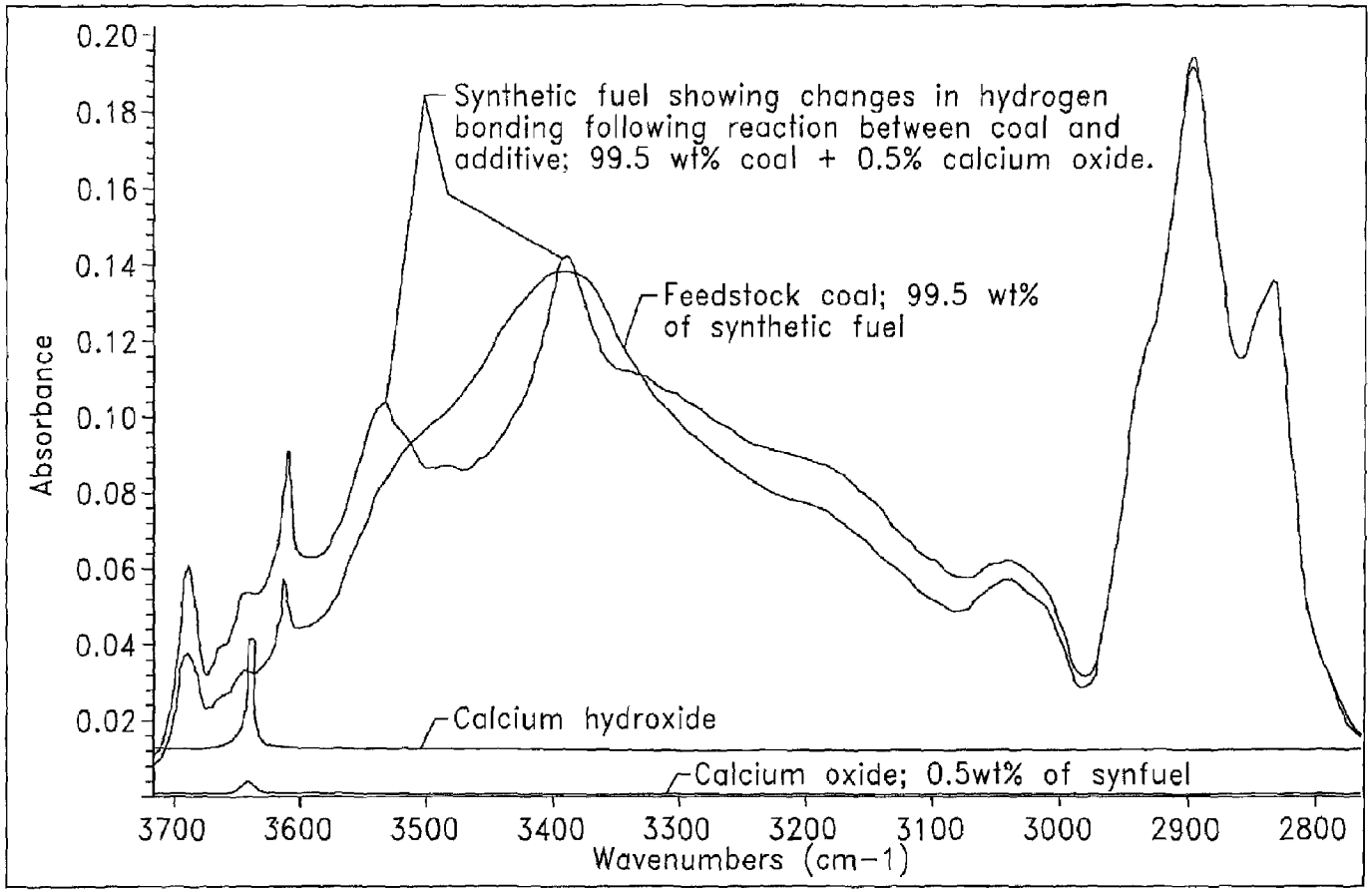
FIG. 1 is an FTIR spectral comparison of synthetic fuel starting materials to a synthetic fuel of this invention showing a clear chemical change between approximately 2750 $cm^{-1}$ and 3750 $cm^{-1}$.

For the purposes of promoting an understanding of the principles of the invention, reference now will be made to the embodiments illustrated in the drawings and specific language will be used to describe the same. It will nevertheless be understood that no limitation of the scope of the invention is thereby intended. The invention includes any alterations and further modifications in the illustrated devices and describes methods and further applications of the principles of the invention which would normally occur to one skilled in the art to which the invention relates.

The present invention provides synthetic fuels, additives and methods for making synthetic fuels. This invention addresses the shortcomings of prior art by providing: (1) methods and materials for producing synthetic fuel having a consistent and independently verifiable chemical change, (2) a preselected chemical change additive that works with all coal materials, (3) a significant cost savings over currently available methods, (4) a chemical additive that burns efficiently thus increasing the efficiency of power production, (5) a chemical additive that reduces the amount of Priority Air Pollutants emitted by coal-fired power plants, and (6) synthetic fuels that are an attractive alternative to imported petroleum thereby reducing U.S. power plant reliance on foreign suppliers.

In one embodiment, a method for preparing a synthetic fuel of the present invention includes mixing a chemical change additive with solid combustible materials to produce synthetic fuel. The chemical change additive is present in the synthetic fuel in an amount less than about 1 percent by-weight of the synthetic fuel. Preferably, the chemical change additive is present in the synthetic fuel in an amount between about 0.2 percent and about 1 percent by-weight of the synthetic fuel. Most preferably, the additive is present in an amount of 0.20-0.75%. In one particularly preferred embodiment, the additive is present in an amount of about 0.3 percent to about 0.4 percent by-weight of the synthetic fuel product. Another preferred amount is 0.375 percent chemical change additive by-weight of the synthetic fuel product.

The combustible materials to be transformed into synthetic fuel upon addition of the chemical change additive include solid fuel materials or products such as carbonaceous materials with sufficient BTU value to be used by power generation plants, coke ovens, steel mills or other furnace dependent industries. These materials are typically coal or coal fines but can also include municipal wastes or biomass. Certain embodiments of the present invention include the partial substitution of coal fines with municipal wastes, biomass or the like at levels of about 1 to about 50 or 60 percent by-weight of the final synthetic fuel product. However, any suitable combustible material is contemplated. This substitution allows for the utilization of other fuel sources that may qualify for the Section 29 tax credit. It is presently preferred that the particle size of the selected combustible material described herein be less than about 3 inches in diameter.

The chemical change additive is selected from the group consisting of alkaline earth oxides, alkaline earth hydroxides and mixtures thereof. The alkaline earths can be characterized as metals that burn brightly when heated in oxygen to form their corresponding white oxides. These metals are generally magnesium, calcium, strontium and barium. The oxides and hydroxides of these metals can be used in any combination as the chemical change additive. Dolomite is one example of a naturally occurring combination of alkaline earths that can be used as the chemical additive of the present invention. Any suitable alkaline earth oxide, hydroxides or combinations thereof will be obvious to those having ordinary skill in the art.

It is contemplated that persons of ordinary skill in the art will understand the equilibrium of alkaline earth oxides. These compounds readily convert from the oxide form to the hydroxide form in the presence of air or water. They are more stable in the hydroxide form in water. However, eventually the compounds will convert to the carbonate form, in the case of calcium, limestone.

In one embodiment, the present invention provides a method and composition for synthetic fuel production where the chemical change additive is calcium based, (e.g., calcium hydroxide or calcium oxide), and is delivered to a mixing vessel or system in dry form for combination with coal or coal fines or other carbonaceous fuel source, carbon dioxide and inherent or added moisture to form the synthetic fuel of the present invention.

There are a variety of ways in which the chemical change additive can be combined with the coal fines. The simplest is the simultaneous injection or combination of coal, dry additive, water, and carbon dioxide to the entry of a screw blender, plug mill or any other blending systems currently used by the qualifying synthetic fuel plants. An embodiment of the present invention contemplates that the dry additive can be slurried with water in the range of 3 to 20 parts water to one part additive by-weight prior to being injected or sprayed into the blender where it is mixed with the coal or other combustible fuels and carbon dioxide. In this embodiment, it is not necessary to add water to the blender or plug mill because the water in the slurry is sufficient to activate the chemical change additive. In this embodiment, the chemical change additive may also be mixed by spraying directly onto the combustible material without the aid of a mill or blender. In this embodiment it is preferred that the chemical change additive, once slurried with water, be mixed with the solid fuel product quickly, preferably within 24 hours of slurry preparation.

Although the present invention does not require binders at high concentrations the invention contemplates combining the inorganic additives of this invention with a small concentration of a second, organic additive. For example, the second additive can be an undiluted liquid, aqueous slurry or emulsion prepared from asphalt or another hydrocarbon source. The advantage of this embodiment is enhancement of chemical change without adding high levels of hydrocarbon. In fact, synthetic fuel with the low levels of hydrocarbon contemplated in this embodiment exhibit few of the handling problems that are typical of briquetted fuels having high hydrocarbon content.

In one presently preferred embodiment, the preselected chemical change additive is calcium hydroxide or calcium oxide, and the concentration of the calcium oxide or calcium hydroxide is between about 0.2 percent to about 1 percent by-weight, and the concentration of the asphalt is between about 0.5 percent and 3 percent by-weight of the final synthetic fuel product.

Also provided by the invention is a composition for blending with the predetermined starting components, e.g., coal or coal fines, wherein the composition comprises the preselected chemical change additive in an aqueous slurry or emulsion prepared from tall oil. In one presently preferred embodiment, the chemical change additive is calcium hydroxide or calcium oxide, and the concentration of the calcium oxide or calcium hydroxide is between about 0.2 percent and about 1 percent by-weight, and the concentration of the tall oil is between about 0.5 percent to about 3 percent by-weight of the final synthetic fuel product. It will also be appreciated by one of skill in the art that other combustible materials can be substituted to a certain extent for the coal fines as solid fuel waste. One embodiment includes the addition of coal tar pitch, biomass or municipal waste to the composition comprising the preselected chemical change additive for admixing with coal or coal fines to produce the synthetic fuel as set forth herein.

Another preferred method of addition of the chemical change additive would be by utilizing a composition comprised of an aqueous slurry of the chemical change additive as described above with an emulsion of asphalt, tall oil, molasses, or other combustible liquid hydrocarbon, then injecting this composite liquid in composition into the blending system. This manner of injection is preferred as it provides a more uniform coverage of the coal or fuel particles and, in turn, a more extensive reaction. The ratios used in this embodiment can be adjusted to provide a preferred final concentration range in the synthetic fuel product of 0.25 percent to 0.75 percent by-weight of the chemical change additive, e.g., calcium hydroxide or calcium oxide, and from 0.5 percent to 3 percent by-weight of the liquid hydrocarbon emulsion.

Compositions of the invention that include a second, organic additive may further comprise a surfactant or emulsifying agent added at a final concentration of between about 0.05 percent to about 1 percent by-weight of the liquid hydrocarbon or hydrocarbon emulsion. Suitable surfactants are known in the art.

The addition of carbon dioxide in gaseous form directly to the blending system enhances the observed reactions, although, for most operations, there is sufficient atmosphere carbon dioxide to drive the reaction without the addition of this gas. Moisture is needed to hydrate the chemical change additive in order to drive the reaction. This moisture may be obtained from the coal or substituted combustible fuels if these materials contain sufficient moisture or may be added during blending if the fuel is dry.

The methods disclosed may be efficiently conducted at ambient temperatures and pressures such that the combination of the starting components are produced and the composition produces a consistent and measurable change detectable in the synthetic fuel so produced. Ambient temperatures and pressures include room temperature and pressure, outside temperature and pressure, i.e. those temperatures and pressures that are not artificially induced. In contrast to the coal briquetting or pelletizing processes, compaction, compression, heating or extrusion steps are unnecessary in order to obtain the prerequisite chemical change, thereby permitting significantly higher throughput for a given synthetic fuel plant.

The present invention also provides methods of producing a synthetic fuel having a consistent and measurable change comprising combining predetermined starting components, such that the resultant synthetic fuel has a consistent and measurable change in the chemical structure of the preselected starting components.

Another advantage of the invention is that the use of small-diameter coal particles is not a requirement as is the case for briquetting, pelletizing or extrusion processes, as the chemical change additive of the invention is effective in inducing chemical change when combined with coal particles in sizes up to 3 inches. In one embodiment, a synthetic fuel is provided in which the final synthetic fuel product induces a chemical change in the structure of the starting components, which can be detected by infrared spectroscopy, as the appearance or change in absorption bands in the range of either 3100 to 3600 $cm^{-1}$ and 1050 to 1150 $cm^{-1}$, or in the range of 3100 to 3600 $cm^{-1}$ and 1400 to 1500 $cm^{-1}$ or in the range of 1400 to 1500 $cm^{-1}$ and 860 to 880 $cm^{-1}$, with the changes being indicative of either a newly formed chemical bond(s) of or an increase in the concentration of a chemical bond(s) in the synthetic fuel that absorbs radiation in the specified spectral regions.

Further embodiments of the invention comprise an efficient method for production of a synthetic fuel from the methods and compositions as described herein whereby any additional steps of drying, extrusion, briquetting, or pelletizing are not required. In another embodiment, the efficiency is further increased by allowing the synthetic fuel to cure in air to permit absorption of atmospheric carbon dioxide, thereby eliminating the need to add carbon dioxide in the blending or mixing system. In particular, the present invention provides a composition and method for producing a synthetic fuel having a consistent measurable chemical or structural change in the starting components comprising: the addition of low levels of a preselected chemical change additive, e.g., calcium oxide and calcium hydroxide, or other suitable additive to a combustible fuel such as coal or coal fines in the presence of moisture and carbon dioxide.

The presently preferred chemical change additive, calcium hydroxide, calcium oxide or a mixture thereof is equally effective when municipal waste or biomass are partially or totally substituted for the coal over a wide range of additive concentrations, e.g., 0.2 percent to 1.0 percent by-weight. However, due to cost considerations and the efficiency of the power plant utilizing the fuel, the preferred range of the preferred chemical change additive addition is between 0.25 percent and 0.75 percent by-weight which is sufficient to induce a measurable chemical change in the fuel product. In addition to the calcium-based additives, other alkaline earth oxides or hydroxides, e.g., magnesium oxide or hydroxide is equally effective as a chemical change additive.

Another embodiment of the present invention is a composition for use in converting solid fuel products to synthetic fuel. This composition is a 25 percent by weight aqueous solution of the chemical change additive described herein. The composition preferably useful for converting solid fuel waste material to synthetic fuel according to the methods herein described. In another embodiment this composition also contains asphalt, tall oil, molasses, liquid hydrocarbon or combinations and emulsifications thereof at a concentration of 40 percent of the aqueous solution. It is contemplated that this embodiment can be emulsified to aid in reducing its viscosity. With this lower viscosity embodiment the solid fuel product has been shown to be coated more efficiently. This efficiency allows for the reduction in the effective dosage making the additive of the present invention even more economical.

Laboratory tests and fuel demonstration runs in full-scale synthetic fuel plants have included the production of a synthetic fuel by combining coal fines with a chemical change additive in all matters as it is described herein. These demonstration runs have been conducted with the chemical change additive being combined in both dry form and as an aqueous slurry with coal fines in conjunction with an asphalt-based emulsion. Infrared spectroscopy analysis of the synthetic fuel produced in all tests to date have shown that a clear and measurable change did occur in the starting components following blending both with and without subsequent briquetting. The precise nature of these interactions has been shown to be somewhat dependent on the coal being used as the two different interactions have been observed when different coals were used. For one set of coal samples, this interaction was evidenced as significant changes in the absorption or of infrared radiation measured in the 3300 to 3600 $cm^{-1}$ range and between 1050 and 1150 $cm^{-1}$. The former absorption suggests changes have occurred in the hydrogen bonding within the coal matrix. These changes are believed to be related to interactions between calcium hydroxide and the hydroxyl (—OH) functional groups that are integral to the coal structure. It is further believed that the carbon dioxide may increase the efficiency of such a reaction as the formation of carbonate ions ($HCO_3^-$ and $CO_3^{-2}$) following dissolution of the $CO_2$ in the added or inherent water which could potentially assist in the removal of the hydrogen atoms from the hydroxyl functional groups within the coal matrix, thereby catalyzing the reaction between the chemical change additive and the ionized hydroxyl groups on the coal surface. The changes in the absorption band centered around 1100 $cm^{-1}$ is congruent with this proposed interaction. Absorption of infrared radiation in this region of the spectrum is generally attributed to carbon-oxygen bonds, the bonding as absorption in this region of the spectrum. It is generally attributed to carbon-oxygen bonds, bonding energy of which, and, in turn, the absorption spectrum of which, would also be impacted by the proposed reaction.

In other coals, changes in the chemical bonding were also measured around 3300 to 3600 $cm^{-1}$ as well as near 870 $cm^{-1}$ and 1440 $cm^{-1}$ following blending. The changes around 3300 to 3600 $cm^{-1}$ are attributed to changes in the hydrogen bonding of the coal surface. Only for this class of coal, this change usually manifests either an increase in intensity or as a shift to lower wave numbers for the absorption maximum as opposed to a sharpening of the H-bond absorption peak as for the former class of coals. The change in chemical bonding responsible for the change in absorption around 1440 $cm^{-1}$ are usually attributed to change in absorption by $CH_2$ groups for an organic matrix such as coal or to a change in carbonate bonding for inorganic matrices.

In all cases, the presence of these changes is not immediately apparent and can only be discerned by using careful quantitative laboratory techniques in which all parameters which potentially would mask these interactions (e.g., sample concentration, moisture content, equilibrium time during the measurement, the method of sample preparation, etc.) are carefully controlled and kept constant. Thus, the detection in measurement of these changes are difficult to conduct, even for a trained spectroscopist. Finally, one element of the nature of the changes in the molecular bonding are not always known with certainty, due to the nature of the infrared analysis, the detection of a change in the frequency or extent of absorption of infrared radiation by the product relative to that of the starting components provides unequivocal evidence of a change in the nature of the chemical bonding in the product.

The advantages of the present invention will now be made by way of example.

EXAMPLES

Example 1

Medium sulfur blend coal of Kentucky was blended with a 25 percent solution of $Ca(OH)_2$ to generate two synthetic fuels, each having concentrations of 0.375 percent and 10 percent chemical additive by-weight coal respectively. Each coal chemical solution was mixed in a Hobart lab mixer to assure uniform mixing, and the coal was allowed to react to absorb carbon dioxide from the air by placing the mixture on a steel table overnight. Fusion temperature of the ash from the coal before treatment and after chemical treatment was performed according to ASTM Method D1857. The fusion temperatures of the 0.375 and 10 percent synthetic fuels were compared with a control coal sample. The results of this analysis are shown in Table 1.

TABLE 1

Fusion Temperatures of High and Low $Ca(OH)_2$ Additive

| | INITIAL DEFORMATION (IT) | SOFTENING TEMPER-ATURE (ST) | HEMI-SPHERIC (HT) | FLUID (FT) |
|---|---|---|---|---|
| Untreated Coal | 2560 | 2590 | 2610 | 2650 |
| 0.375% Treated Coal | 2460 | 2515 | 2535 | 2580 |
| 10% Treated Coal | 2260 | 2290 | 2330 | 2370 |

As Table 1 depicts, the sample with the high concentration of chemical change additive showed a decrease in fusion temperature.

Example 2

Medium sulfur blend coal of Kentucky was blended with a 25 percent solution of $Mg(OH)_2$ to generate two synthetic fuels, each having concentrations of 0.375 percent and 10 percent chemical additive by-weight coal respectively. Each coal chemical solution was mixed in a Hobart lab mixer to assure uniform mixing, and the coal was allowed to react to absorb carbon dioxide from the air by placing the mixture on a steel table overnight. Fusion temperature of the ash from the coal before treatment and after chemical treatment was performed according to ASTM Method D1857. The fusion temperatures of the 0.375 and 10 percent synthetic fuels were compared with a control coal sample. The results of this analysis are shown in Table 2.

TABLE 2

Fusion Temperatures of High and Low $Mg(OH)_2$ Additive

| | INITIAL DEFORMATION (IT) | SOFTENING TEMPER-ATURE (ST) | HEMI-SPHERIC (HT) | FLUID (FT) |
|---|---|---|---|---|
| Untreated Coal | 2560 | 2590 | 2610 | 2650 |
| 0.375% $Mg(OH)_2$ | 2500 | 2560 | 2610 | 2645 |
| 10% $Mg(OH)_2$ | 2355 | 2395 | 2455 | 2495 |

As table 2 depicts the fusion temperature reduction with high levels of $Mg(OH)_2$ is also pronounced.

Example 3

Medium sulfur blend coal was blended with a 25 percent solution of dolomitic lime solution (14 percent Mg) to prepare two concentrations of synthetic fuel, 0.375 percent and 10 percent chemical additive by-weight coal. Each coal chemical solution was mixed in a Hobart lab mixer to assure uniform mixing, and the coal was allowed to react to absorb carbon dioxide from the air by placing the mixture on a steel table overnight. Fusion temperature of the ash from the coal before treatment and after chemical treatment was performed according to ASTM Method D1857. The fusion temperatures of the 0.375 and 10 percent synthetic fuels were compared with a control coal sample. The results of this analysis are shown in Table 3.

TABLE 3

Fusion Temperatures of High and Low Dolomitic Lime

| | INITIAL DEFORMATION (IT) | SOFTENING TEMPER-ATURE (ST) | HEMI-SPHERIC (HT) | FLUID (FT) |
|---|---|---|---|---|
| Untreated Coal | 2560 | 2590 | 2610 | 2650 |
| 0.375% Dolomite | 2500 | 2565 | 2600 | 2635 |
| 10% Dolomite | 2335 | 2365 | 2410 | 2445 |

From each of examples 1-3 it is clear that there is a correlation between increasing additive concentrations and lowered fusion temperatures. As discussed, the lowering of fusion temperatures relates directly to the production of slag in the burners. The increase in slag build-up in certain combustor configurations reduces the efficiency of the power plant by increasing the frequency and extent of down time. Therefore, high concentrations of chemical change additive present in synthetic fuel may reduce the efficiency of power plants.

Example 4

Figure 2:
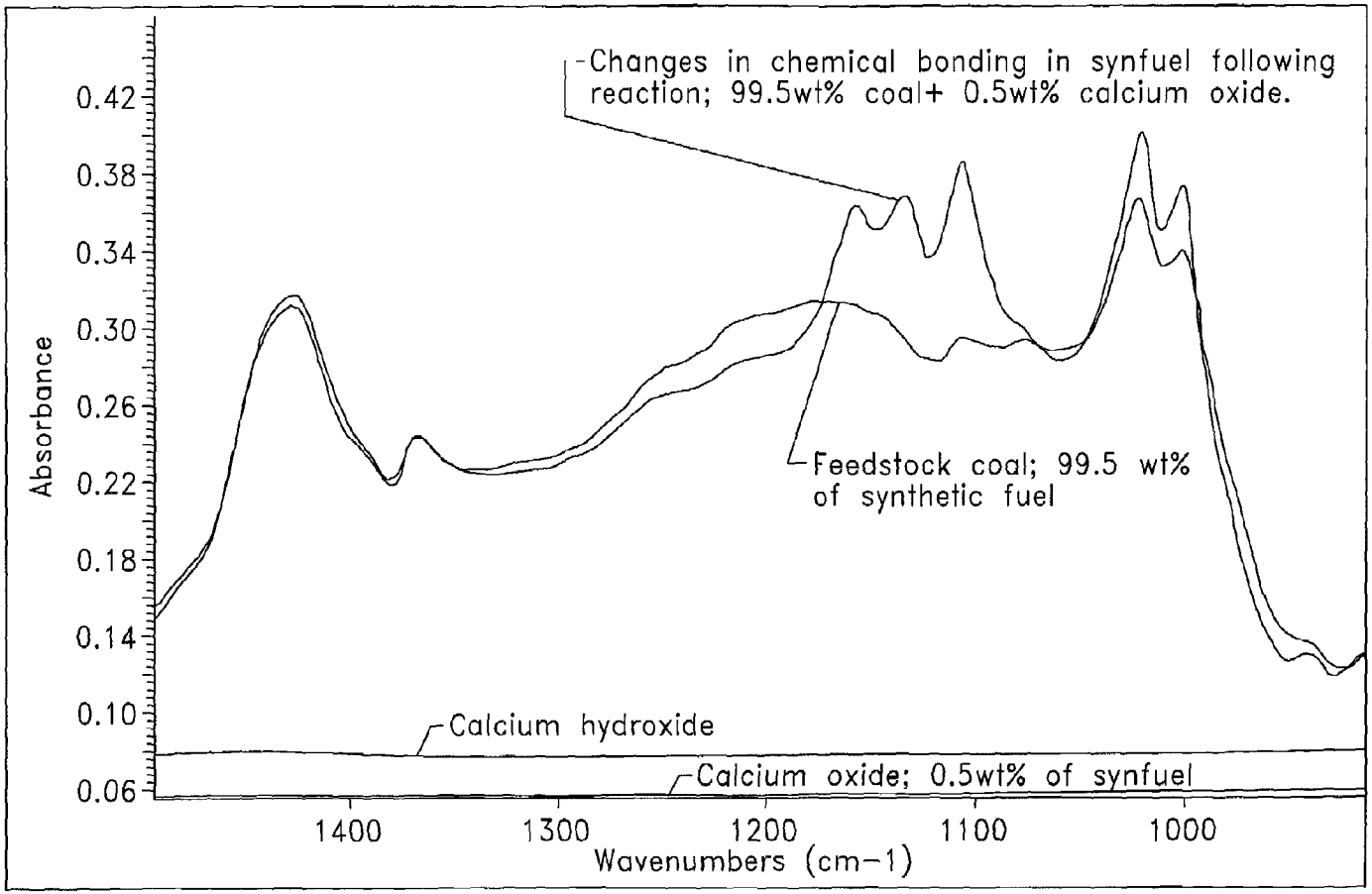
FIG. 2 is an FTIR spectral comparison of synthetic fuel starting materials to the synthetic fuel of FIG. 1 showing a clear chemical change between approximately 900 $cm^{-1}$ and 1500 $cm^{-1}$.

A synthetic fuel was prepared with 0.5 percent chemical change additive $Ca(OH)_2$ with 99.5 percent coal, and the chemical characterization of the synthetic fuel was compared to that of the starting material using FTIR. FIG. 1 represents FTIR from 2750 $cm^{-1}$ to 3700 $cm^{-1}$ and FIG. 2 represents FTIR from 900 $cm^{-1}$ to 1500 $cm^{-1}$. Both of these figures demonstrate a clear chemical change between the starting coal material and the coal as a synthetic fuel.

Example 5

Figure 3:
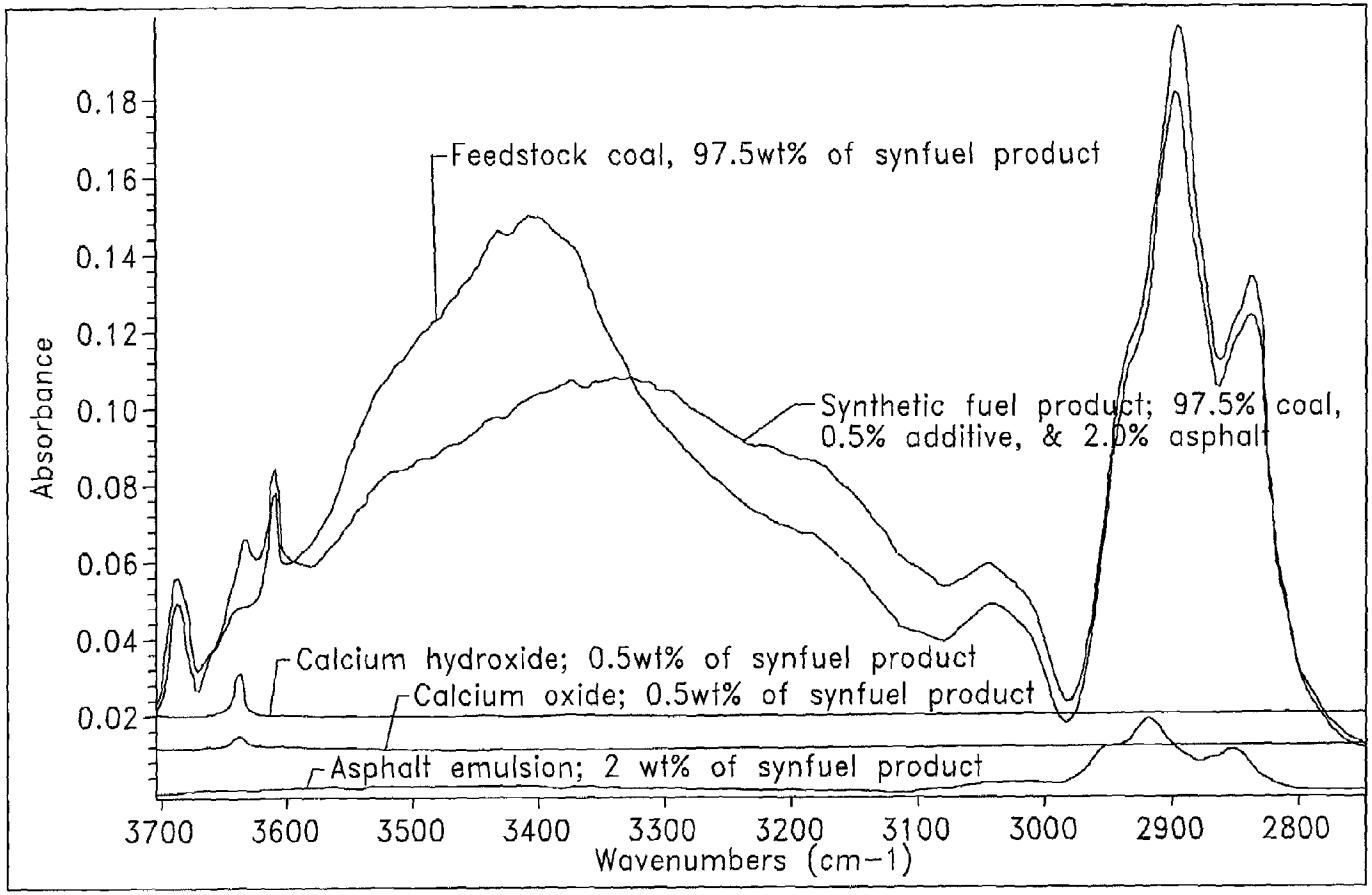
FIG. 3 is an FTIR spectral comparison showing a clear chemical change between approximately 2750 $cm^{-1}$ and 3750 $cm^{-1}$ of synthetic fuel starting materials and a synthetic fuel of this invention.
Figure 4:
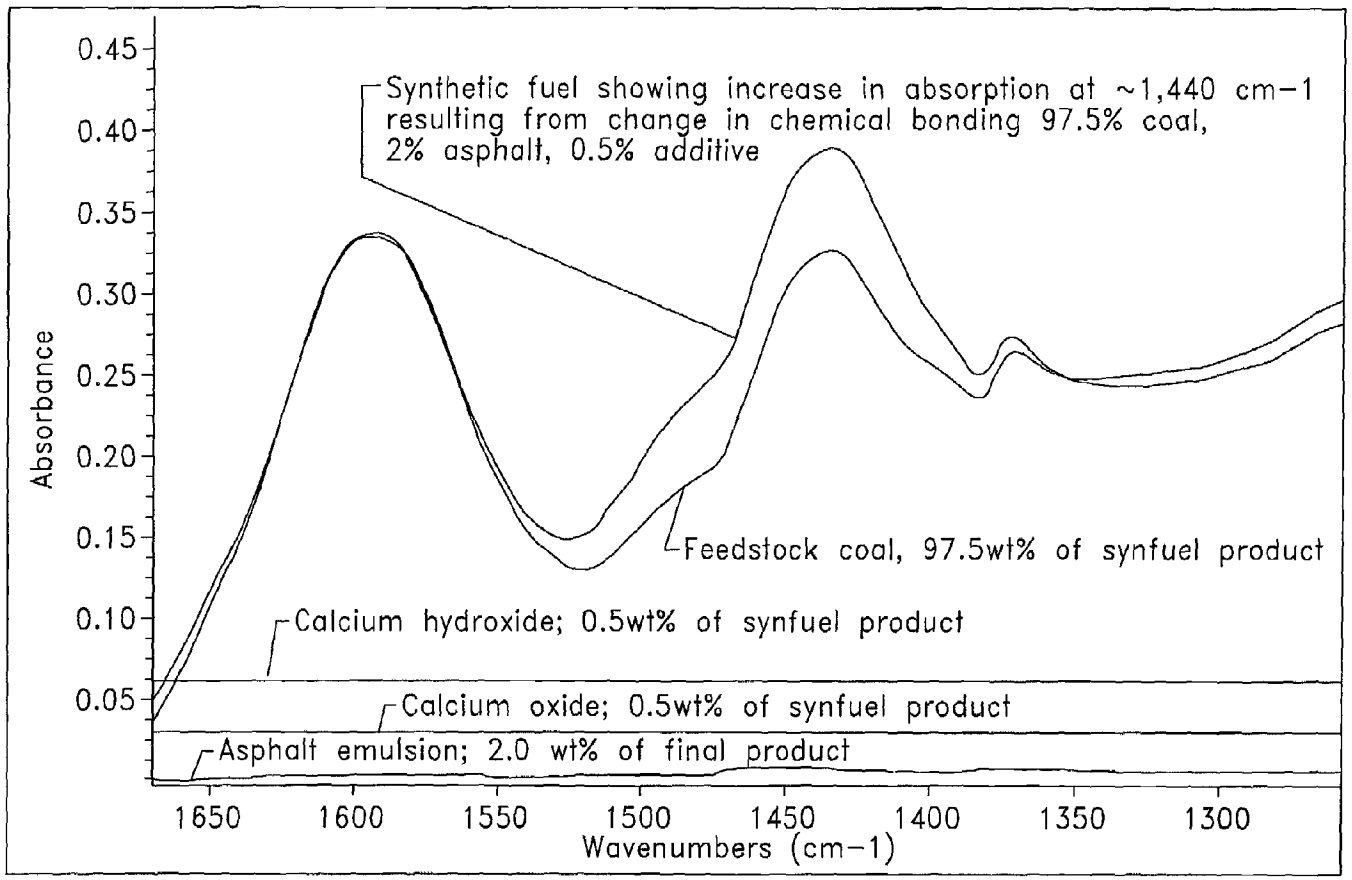
FIG. 4 is an FTIR spectral comparison showing a clear chemical change between approximately 1200 $cm^{-1}$ and 1750 $cm^{-1}$ of synthetic fuel starting materials and the synthetic fuel of FIG. 3.
Figure 5:
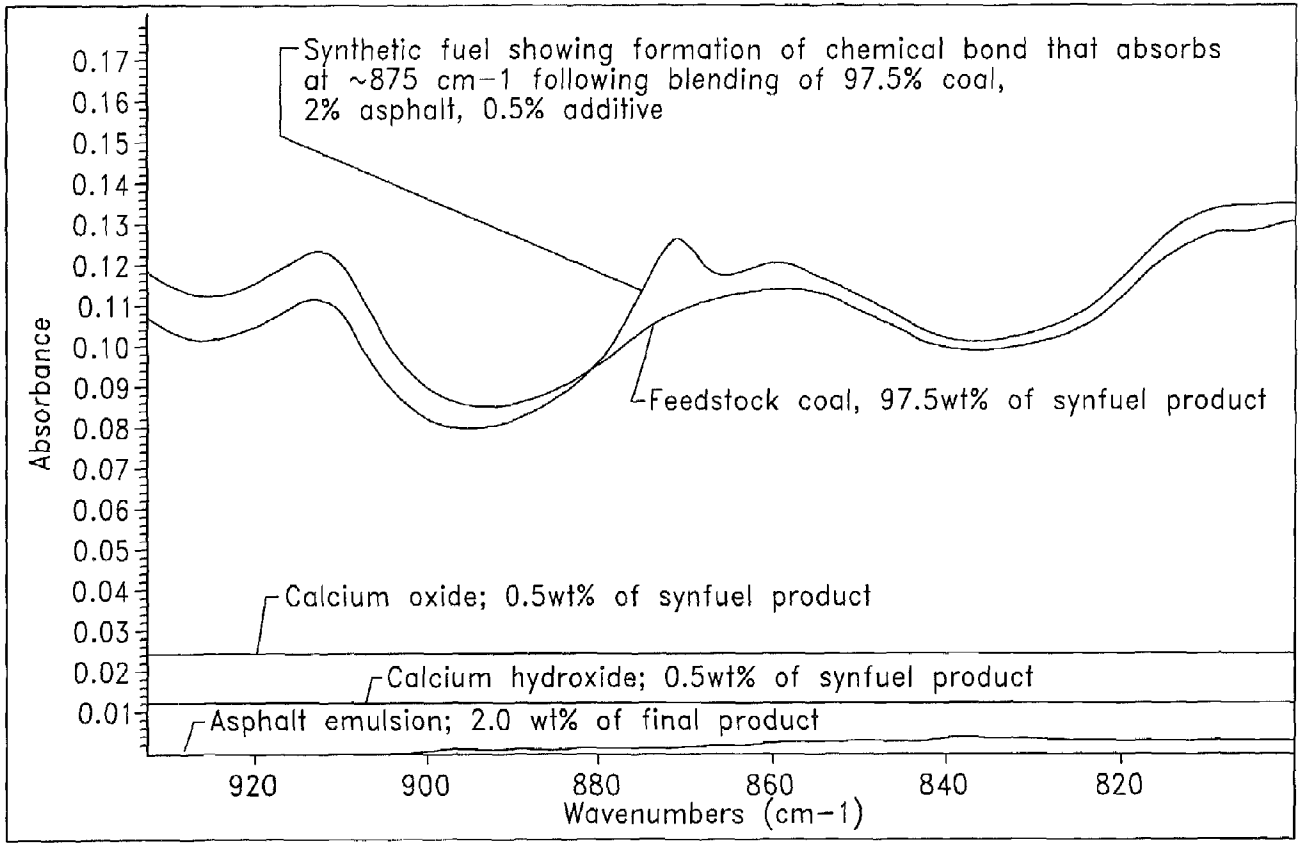
FIG. 5 is an FTIR spectral comparison showing a clear chemical change between approximately 810 $cm^{-1}$ and 940 $cm^{-1}$ of synthetic fuel starting materials and the synthetic fuel of FIG. 3.

Example 5 demonstrates a 2 percent asphalt emulsion and 0.5 percent chemical additive to 97.5 percent coal fines and the chemical change exhibited thereby. FIG. 3 demonstrates the FTIR from 2750 $cm^{-1}$ to 3700 $cm^{-1}$, FIG. 4 demonstrates the FTIR from 1250 $cm^{-1}$ to 1675 $cm^{-1}$, and FIG. 5 demonstrates the FTIR from 800 $cm^{-1}$ to 930 $cm^{-1}$. In each case, a significant chemical change is readily apparent. This example further demonstrates the complete chemical change achieved with the use of low concentrations of both the chemical additive of this invention and hydrocarbon or mixture of hydrocarbons.

Examples 6, 7 and 10

Sample Preparation Summary for Coal Samples to be Analyzed by FTIR

Coal-based samples (parent and synfuel) were crushed, split, screened to −35 mesh, and dried overnight under mild conditions. The synthetic fuel described in these examples was prepared from a combination of 95.5 parts coal, 1.5 parts HES, 0.3 parts dry chemical change additive, and 2.7 parts water in a synthetic fuel plant. The HES binder is a hydrocarbon emulsified with 39 percent water and surfactants. It was obtained from Asphalt Materials, Inc., 5400 West 86$^{th}$ Street, Indianapolis, Ind. 46268. The control blend was prepared in the laboratory from the same starting ingredients that were combined at the same ratios. An aliquot of a HES binder was also dried prior to analysis with a post-run correction being made for weight loss during drying, i.e., corrected to an as-received weight basis. The solid additive, which was comprised of commercial-grade calcium oxide, was sampled directly in its as-received form (no drying step). Weighed aliquots of each sample were blended with KBr and then pressed into salt disks for FTIR spectroscopic analysis.

A minimum of three replicate infrared transmission spectra were obtained for each of the study samples. Each of the replicate spectra were then baseline corrected and normalized to a 1-mg basis before being combined and averaged. As will be shown in examples 6, 7 and 10 using this approach, significant changes in the absorption spectra were detected in three spectra ranges so they can only be due to changes in the chemical bonding of the starting components following blending and/or processing.

Example 6

Figure 6:
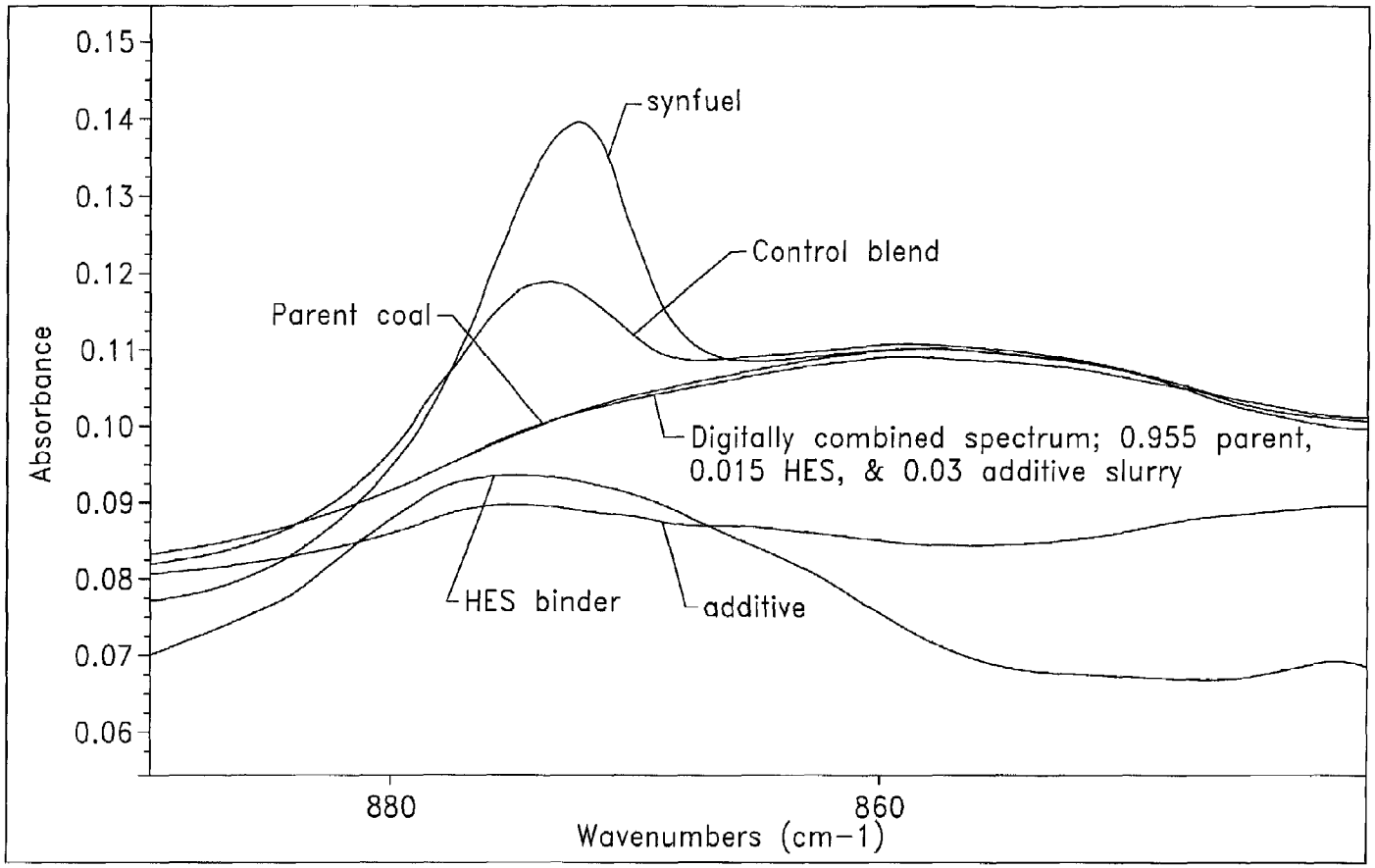
FIG. 6 is an FTIR spectral comparison demonstrating chemical change between synthetic fuel starting materials and a synthetic fuel of this invention at approximately 875 $cm^{-1}$.
Figure 7:
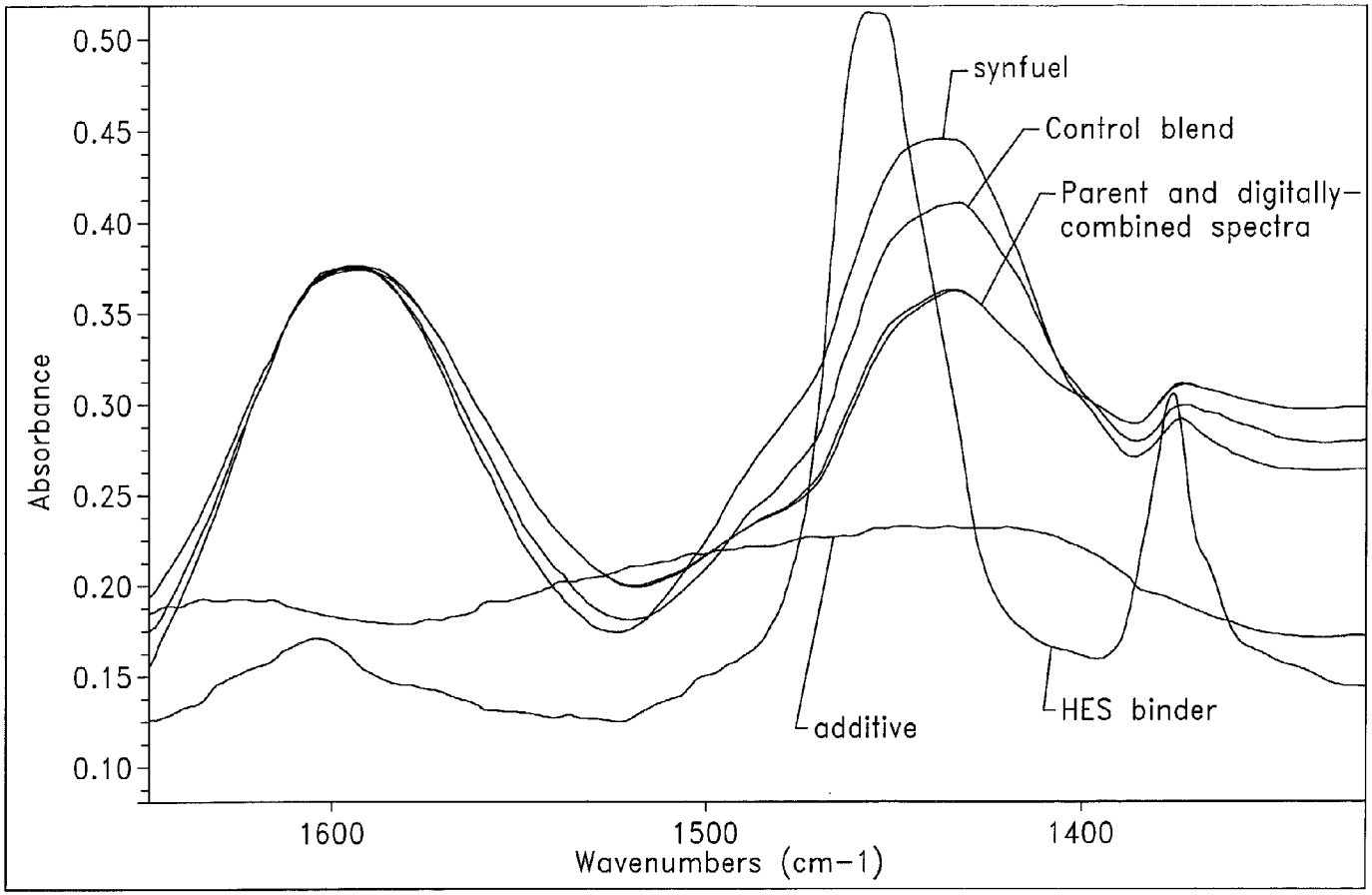
FIG. 7 is an FTIR spectral comparison of synthetic fuel starting materials to the synthetic fuel of FIG. 6 showing a clear chemical change between approximately 1320 $cm^{-1}$ and 1650 $cm^{-1}$.
Figure 8:
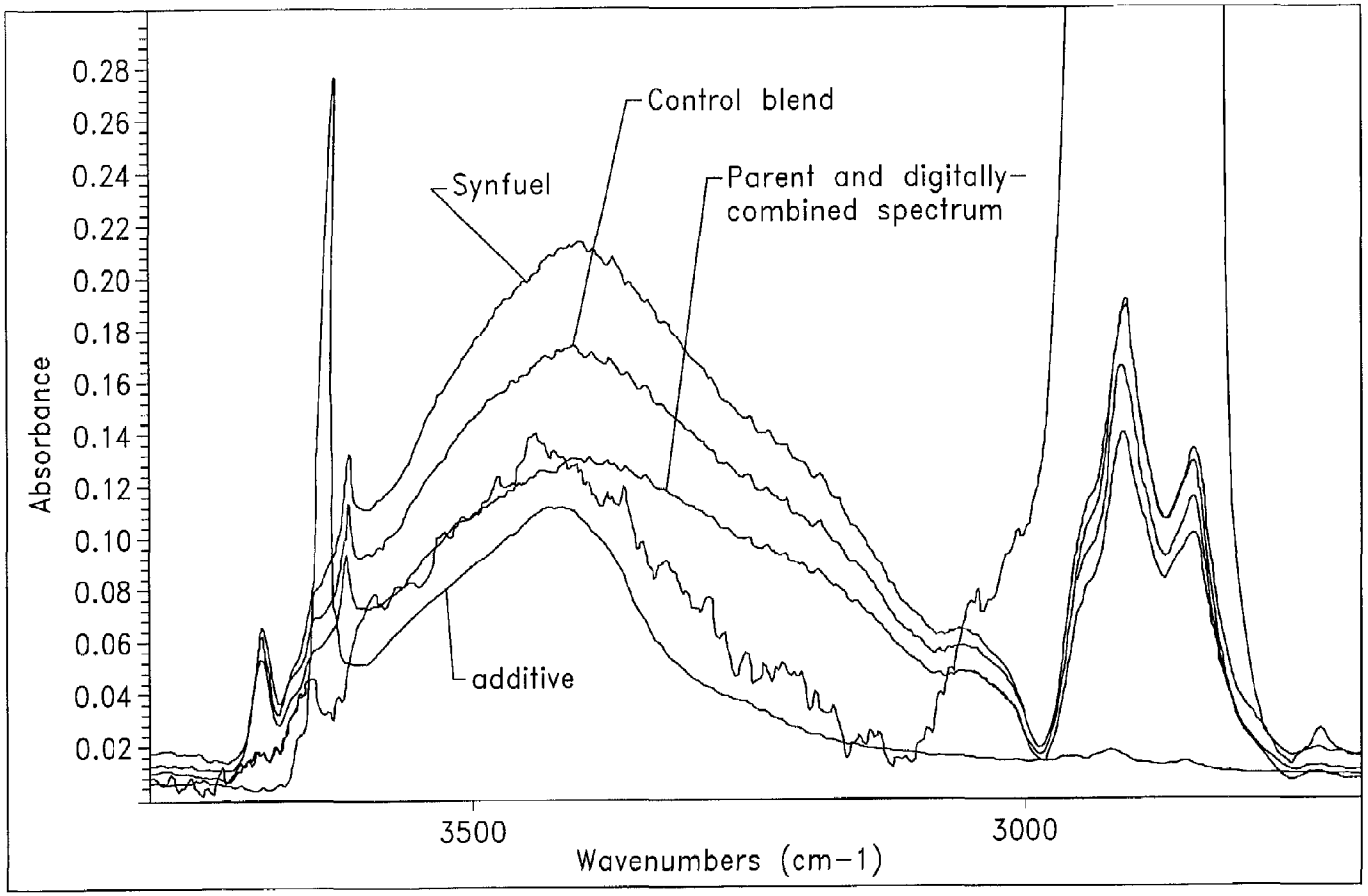
FIG. 8 is an FTIR spectral comparison of synthetic fuel starting materials to the synthetic fuel of FIG. 6 demonstrating chemical change at approximately 3420 $cm^{-1}$.

Three spectra are demonstrated here in FIGS. 6, 7 and 8. Each spectra represents a different region of the FTIR spectrum. FIG. 6 demonstrates a region around 875 $cm^{-1}$. The spectra show the presence of an absorption band in the synfuel and control blend that is absent in the spectra of the starting components (parent coal, HES, and calcium oxide additive). Due to the nature of absorption of infrared radiation, appearance of the 875 $cm^{-1}$ band provides unambiguous evidence of the presence of a newly formed chemical bond in the synthetic fuel and control blend that is not present in any of the starting components.

The spectra shown in FIG. 7 are shown expanded between 1320 and 1650 $cm^{-1}$ to highlight a second change that was detected in the chemical bonding of the synfuel and control samples. After plotting to the same scale, the parent coal, synfuel and additive spectra, were vertically aligned at 1600 $cm^{-1}$ in order to more clearly illustrate the increase in the absorption maximum near 1440 $cm^{-1}$ observed in the synfuel and control blend samples. Absorption at 1440 $cm^{-1}$ is generally attributed to aliphatic C—C bonds or to $CO_3$ functional groups. The calcium oxide additive spectrum does not exhibit an absorption band in this region, but the HES binder does exhibit an absorption band nearby at 1460 $cm^{-1}$.

A third change in the absorption of infrared radiation is shown in FIG. 8, which reveals an increase in absorption near 3420 $cm^{-1}$ by both the synfuel and control blend samples relative to the parent coal and the digitally combined spectrum. While both the HES and calcium oxide additive samples absorb radiation in this region, the magnitude of absorption in these samples is about the same or less than that observed for the parent coal. The combination spectrum illustrates the extent of absorption anticipated from a weighted, linear combination of the starting components in the absence of chemical interaction between these materials. Absorption in the spectral region from 3200 to 3600 $cm^{-1}$ is assigned to hydrogen bonding (H-bonding). H-bonding can be defined as intermolecular or through-space bonding of hydrogen atoms to nearby O, S, N, or F atoms that are attached to the same or separate molecular structures. Thus, the significantly greater absorption of infrared radiation in this region by the synfuel control blend samples indicates a higher concentration of and/or more strongly absorbing hydrogen bonds in these samples relative to the starting components. Since this level of the H-bonding is not observed in the individual spectra of the starting components, nor in the weighted, combination spectra, the observed increase in absorption can be attributed to chemical interactions between the parent coal, the HES, and the calcium oxide additive following blending. Such changes are consistent with prior work in which absorption of infrared radiation in this spectral region has often been shown to be altered when a complex hydrocarbon such as HES is combined with a coal of bituminous rank. It is also well established that a substantial number of hydroxyl groups (—OH) are present in bituminous coals. It is also known that such groups can and do hydrogen bond with nearby atoms that are prone to such bonding (O, S, N or F). Thus, the changes in the H-bonding shown in FIG. 8 like involves a substantial portion of the functional groups present on the coal particles. Furthermore, studies have generally shown a magnitude of change in H-bonding to be enhanced with the addition of the chemical change additive of the present invention. This permits the H-bonding chemical change to be measured at lower HES concentrations. One manifestation of such a significant change in the extent of hydrogen bonding would be an anticipated increase in briquette strength. That is, the structural integrity of compressed briquettes prepared from the parent coal synfuel, in controlled blend, should correlate with the magnitude of chemical bonding or chemical attraction.

Example 7

Figure 9:
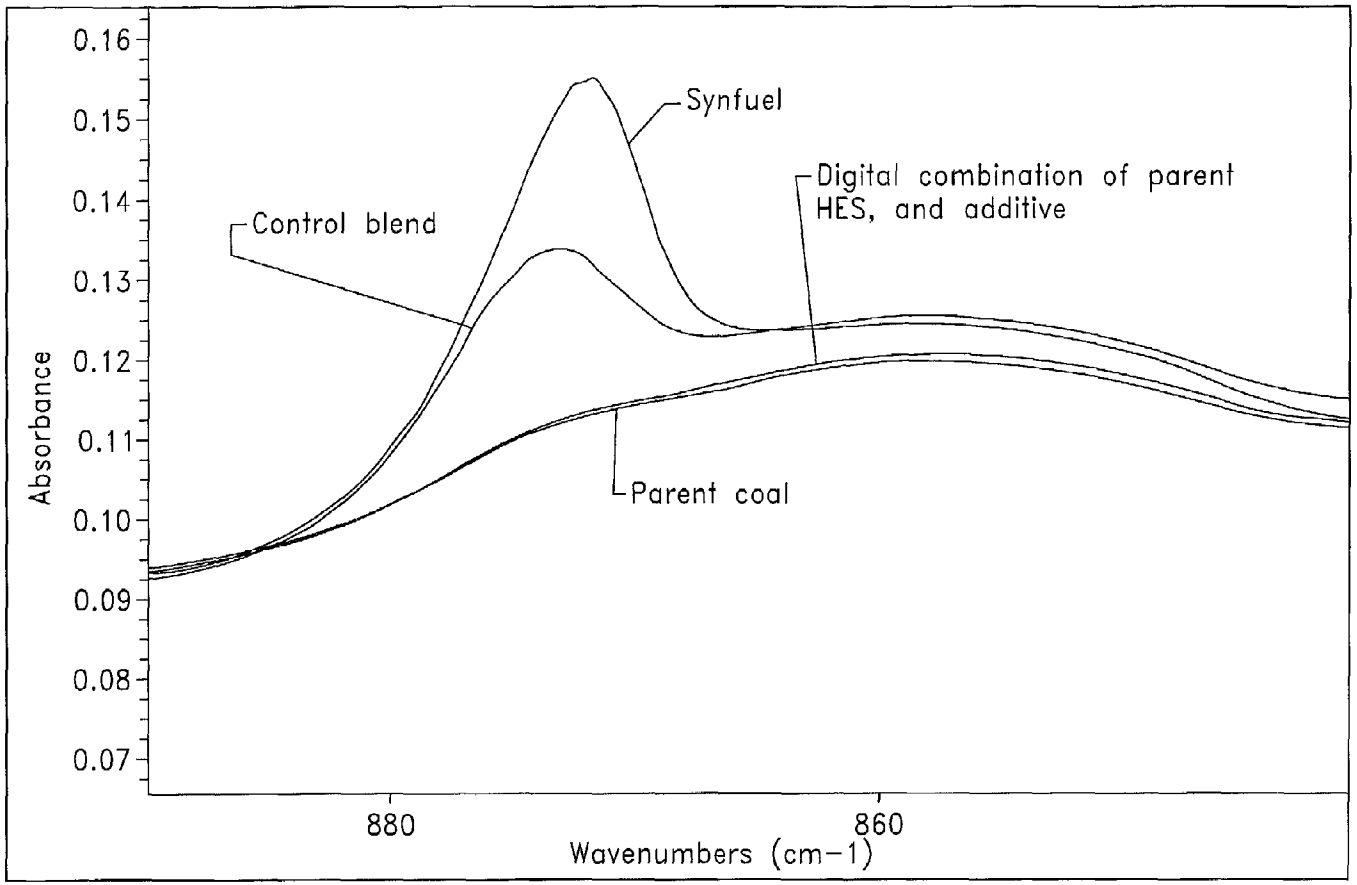
FIG. 9 is an FTIR spectral comparison of synthetic fuel starting materials to a synthetic fuel of this invention demonstrating chemical change at approximately 875 $cm^{-1}$.
Figure 10:
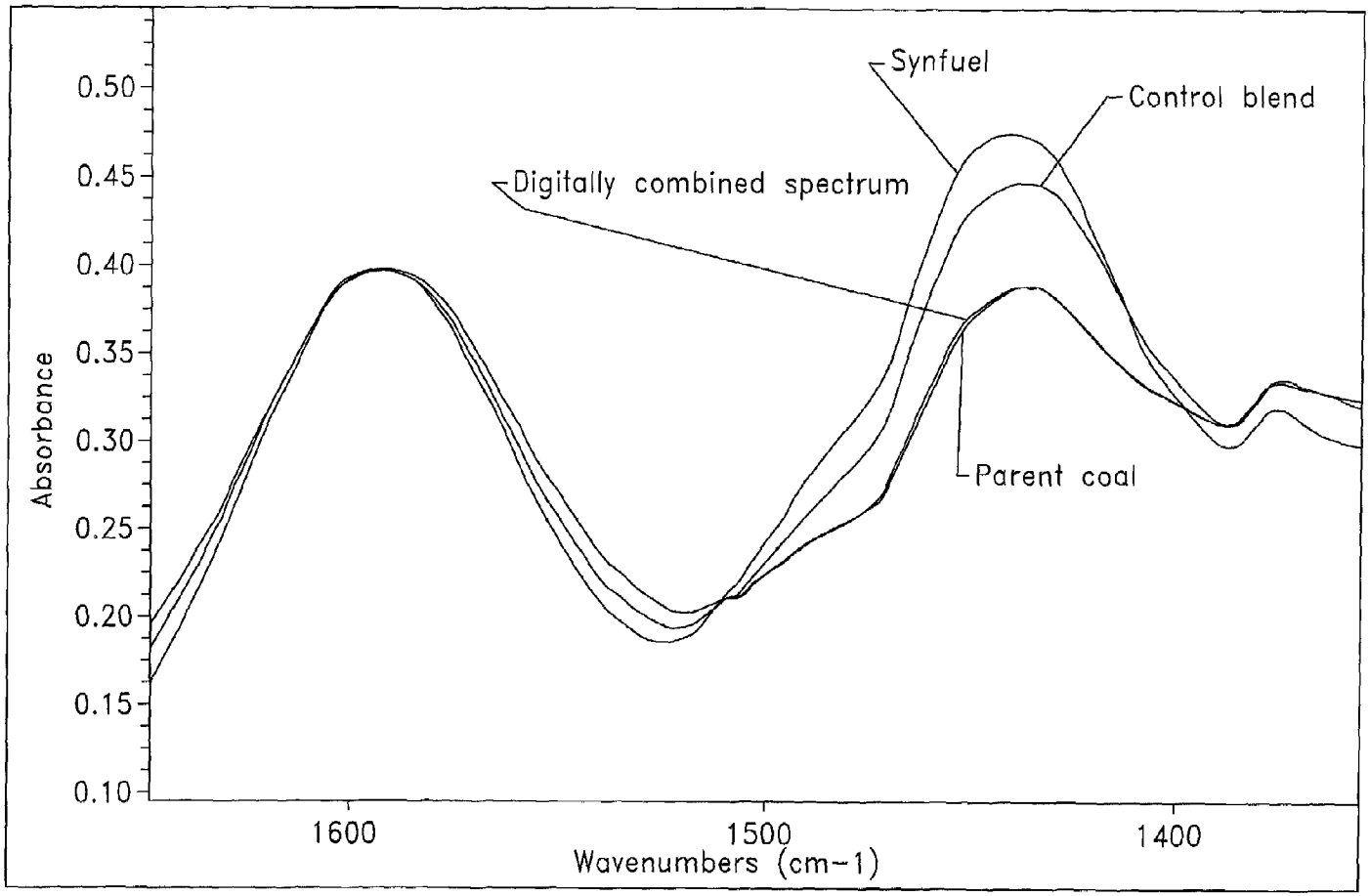
FIG. 10 is an FTIR spectral comparison of synthetic fuel starting materials to the synthetic fuel of FIG. 9 showing chemical change between approximately 1320 $cm^{-1}$ and 1650 $cm^{-1}$.
Figure 11:
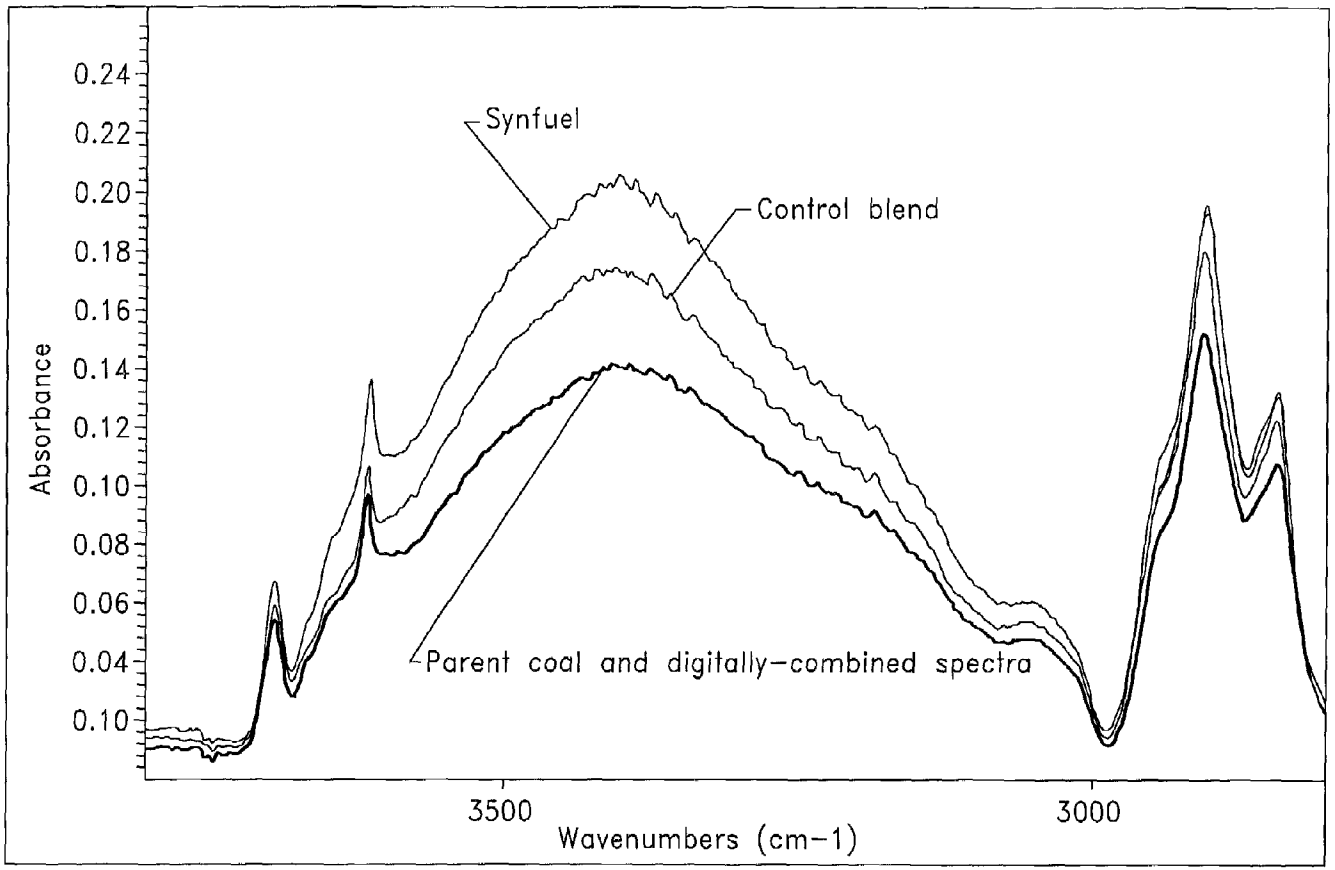
FIG. 11 is an FTIR spectral comparison of synthetic fuel starting materials to the synthetic fuel of FIG. 9 demonstrating chemical change at approximately 3420 $cm^{-1}$.

In order to verify the results of the previous example, a duplicate example was performed. The results of these examples are essentially the same as the result of Example 6. The results of these examples are demonstrated in FIGS. 9, 10 and 11. As before, the combination spectrum at 875 $cm^{-1}$ as represented in FIG. 9 demonstrates a chemical change. FIG. 10 likewise demonstrates a chemical change ratio at 1440/1600 $cm^{-1}$ absorption band. Finally, FIG. 11 shows an increase in absorption near 3420 $cm^{-1}$ for the second round of testing analogous to the spectra shown in FIG. 8.

Example 8

Proximate/ultimate/BTU analyses were performed on two briquetted fuels. The results of this analysis are demonstrated in Table 4.

TABLE 4

Bulk Chemical Analysis

| | Parent Coal | Synthetic Fuel | Control Blend | HES Binder |
|---|---|---|---|---|
| % C | 76.57 | 75.56 | 76.56 | 52.64 |
| % H | 5.86 | 5.85 | 5.58 | 10.98 |
| % N | 1.67 | 1.65 | 1.58 | 0.37 |
| % S | 0.95 | 1.01 | 0.94 | 0.80 |
| % C (dry) | 79.39 | 78.20 | 78.56 | 88.62 |
| % H (dry) | 5.67 | 5.67 | 5.44 | 10.89 |
| % N (dry) | 1.73 | 1.71 | 1.62 | 0.62 |
| % S (dry) | 0.99 | 1.05 | 0.96 | 1.35 |
| H/C (dry) | 0.86 | 0.87 | 0.83 | 1.47 |
| N/C (dry) | 0.019 | 0.019 | 0.018 | 0.006 |
| S/C (dry) | 0.0047 | 0.0050 | 0.0046 | 0.0057 |
| Moisture | 3.6 | 3.4 | 2.5 | 40.6 |
| Vol. Matter | 38.0 | 37.3 | 39.8 | 57.6 |
| Fixed C | 51.8 | 51.2 | 50.7 | 1.6 |
| Ash | 6.6 | 8.1 | 7.0 | 0.00 |
| BTU | 13561 | 13373 | 13512 | 11254 |

These data were collected with the objective of providing information on the potential fuel value of the samples. However, one of the points to be made from these data concerns the water content of the synfuel and control blend versus the parent coal. The free moisture content was determined to be 3.4 and 2.5 percent by-weight for synfuel and control blend, respectively, compared to an as received 3.6 percent by-weight for parent coal. Thus it would appear the addition of HES binder and calcium hydroxide additive slurry ultimately resulted in a measurable reduction in the equilibrium moisture content of the synfuel and control blend samples relative to the parent coal. This is despite the fact that such addition would have additionally elevated the water content by more than 3 percent due to the water content of the HES binder emulsion of the calcium hydroxide additive slurry. The reason for such a reduction in moisture content is not known with certainty but is believed to be due to displacement by calcium hydroxide additive. Regardless of the reason, the addition of the additive results in a synthetic fuel with lower water content and therefore higher BTU value.

This example also brings to light another advantage of the present invention, its increased hydrophobic character. Typically coal is stored without cover from the elements. When there is precipitation the coal absorbs moisture. This moisture reduces the BTU value of the coal. It has been recognized that the synthetic fuel of the present invention has a substantially higher hydrophobic character to that of coal. Because the synthetic fuel of the present invention resists absorbing moisture due to its hydrophobic character, the fuel maintains its BTU value when stored prior to use. This is a significant improvement when one considers that a slight BTU change in fuel can reduce power output significantly.

Example 9

The ash and sulfur content of the synthetic fuel were measured and the results are demonstrated in Table 4 above. This table demonstrates relatively minor increases in ash and sulfur content, while at the same time minor decreases in heating value, total and fixed carbon, and volatile matter for the synfuel sample relative to parent coal. Most of these changes can be attributed to the contribution of the binder and additive in the subsequent reduction of moisture content. However, the slight increase in sulfur content in the synfuel is derived from addition of a higher sulfur content binder, may in part be responsible for the observed increase in H-bonding as sulfur atoms are prone to participate in such reactions.

TABLE 5

Statistical Evaluation of FTIR Replicate Spectra

| | 1,440/1,600 $cm^{-1}$ band ratios (peak maxima from baseline) | | | 3,440 cm−1 band (height from baseline) | | |
|---|---|---|---|---|---|---|
| | Parent coal | Synthetic Fuel | Control Blend | Parent coal | Synthetic fuel | Control blend |
| Mean | 0.485 | 0.829 | 0.667 | 0.120 | 0.205 | 0.162 |
| std dev | 0.018 | 0.064 | 0.020 | 0.007 | 0.027 | 0.022 |
| % rsd | 3.7 | 7.7 | 3.0 | 5.6 | 13.3 | 13.3 |
| n | 4 | 7 | 6 | 4 | 7 | 6 |
| deg freedom* | | 9 | 8 | | 3 | 3 |
| t-calc* | | 164** | 746** | | 7.85*** | 4.50*** |
| t-table (95%) | | 2.26 | 2.31 | | 3.18 | 3.18 |
| t-table (99%) | | 3.25 | 3.36 | | 5.84 | 5.84 |

*relative to parent coal replicates
**assumes unknown/equal variance from F-test
***assumes unknown/unequal variance from F-test The results presented in Examples 6 through 9 clearly reveal significant chemical differences between the synthetic fuel and the raw ingredients from which it was produced. FTIR analysis revealed repeatable and significant changes in synthetic fuel sample in three different spectral regions, including a newly formed absorption band near 875 $cm^{-1}$, and increased absorption near 1440 $cm^{-1}$ and 3420 $cm^{-1}$. Similar results were obtained for the control blend that was prepared in the laboratory using the same proportions of starting materials as was used in the synthetic fuel plant to produce the synthetic fuel, providing a confirmation of the reactive nature of the starting components. The statistical analysis of the replicate spectra of the parent coal and synfuel is shown in Table 5 for the 875 and 1440 $cm^{-1}$ absorption bands. This statistical analysis reveals that the measured changes in chemical bonding are statistically significant with a greater than 95% confidence. The chemical/physical testing indicated minor increases in the ash and sulfur content and minor decreases in heating value, total and fixed carbon, and volatile matter for the synfuel sample relative to the parent coal. The presence of sulfur-containing structures in the binder prepared from the synfuel relative to those prepared from the parent coal are all consistent with the measured increase in hydrogen bonding in the synfuel sample as detected by FTIR analysis.

Example 10

A set of samples was generated by blending aliquots of the parent coal with pairing proportions of HES binder and an aqueous slurry prepared from calcium oxide additive as shown in Table 6 below.

TABLE 6

Varied Amounts of Additive to HES

| SAMPLE | HES BINDER (WT. %) | ADDITIVE (WT. %) |
|---|---|---|
| 1 | 0.0 | 0.50 |
| 2 | 1.0 | 0.375 |
| 3 | 1.0 | 0.50 |
| 4 | 1.25 | 0.375 |

TABLE 6-continued

Varied Amounts of Additive to HES

| SAMPLE | HES BINDER (WT. %) | ADDITIVE (WT. %) |
|---|---|---|
| 5 | 1.25 | 0.50 |
| 6 | 1.50 | 0.50 |
| 7 (Control blend) | 1.50 | 0.375 |

Figure 12:
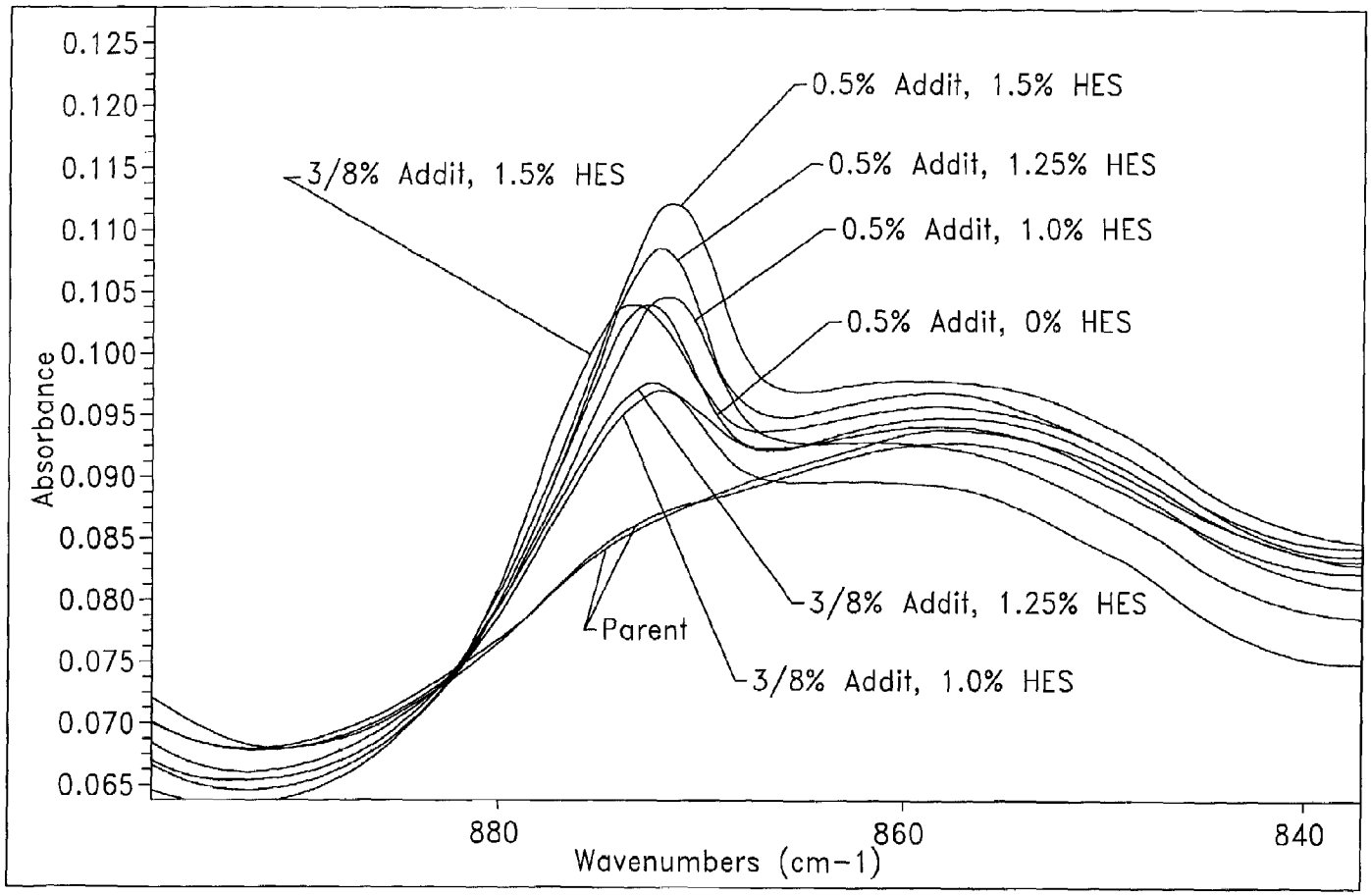
FIG. 12 is an FTIR spectral comparison of synthetic fuel starting materials to a synthetic fuel of the present invention demonstrating chemical change at approximately 875 $cm^{-1}$.

The samples listed above were prepared in the same manner as described for the FTIR samples described above, and the FTIR analysis was performed in the same manner as well. FIG. 12 shows changes in the absorption band near 870 $cm^{-1}$. All seven of the blends containing the chemical change additive of the present invention exhibit a newly formed absorption band at the spectral location which is not present in either of the parent-coal spectra, nor as shown in the preceding report in the spectra of the HES binder or chemical change additive. Note that the intensity of this band is directly related to the concentration of the additive in a given blend. However, in addition to this direct correlation between absorption intensity and additive concentration, there also appears to be a somewhat weaker relation between absorption intensity and HES concentration. This latter can be observed in a comparison of the three blends containing 0.375 percent chemical change additive and differing amounts of HES, as well as in a similar comparison of three samples containing 0.5 percent chemical change additive and differing amounts of HES.

Figure 13:
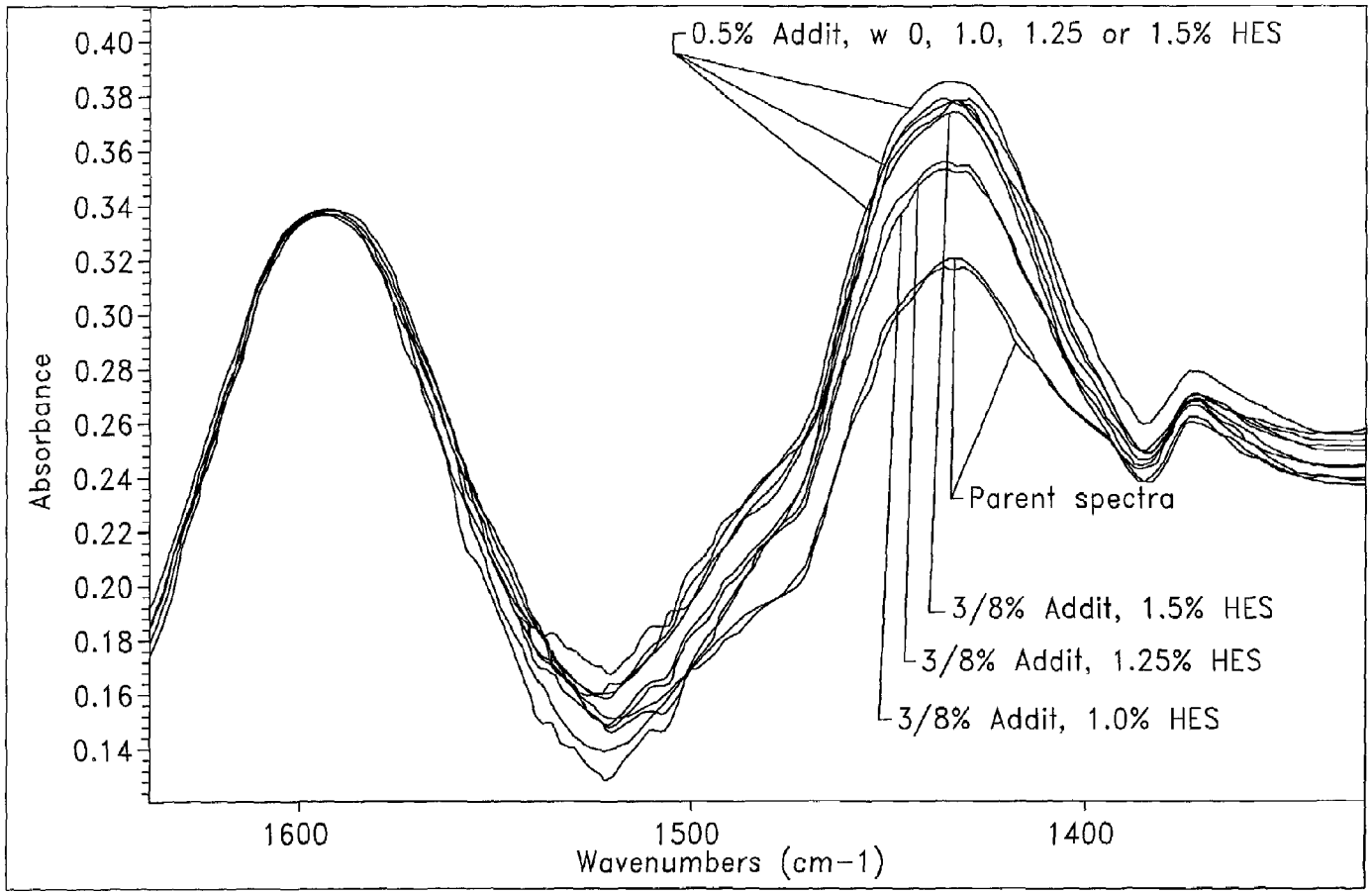
FIG. 13 is an FTIR spectral comparison of synthetic fuel starting materials to the synthetic fuel of FIG. 12 showing chemical change between approximately 1320 $cm^{-1}$ and 1650 $cm^{-1}$.

Together these findings indicate that additive concentration is the key parameter governing the magnitude of the spectral changes observed in the spectral region and the concentration, or at least the presence of HES, appears to enhance the magnitude of the observed changes. Perhaps most important is that there is a measurable and thereby significant change in the chemical bonding apparent in this region of the spectrum, even in the absence of the HES binder. FIG. 13 demonstrates the expanded FTIR region between 1320 $cm^{-1}$ and 1650 $cm^{-1}$. As above, the spectra reveal significant changes in the 1440 $cm^{-1}$ to 1600 $cm^{-1}$ absorption band ratios for the parent coal spectra versus the spectra of the blends containing varying combinations of binder and additive. A statistical evaluation of these data are shown in Table 7 which indicates the increase in absorption at 1440 $cm^{-1}$ for the HES-additive blend spectra, to be significant for all seven blends with a greater than 99 percent confidence, including the single blend that does not contain HES binder. Similar to the trends noted in the 875 $cm^{-1}$ band in FIG. 12, the increase in the magnitude of the 1440 $cm^{-1}$ to 1600 $cm^{-1}$ absorption band ratios shown in FIG. 13 is directly proportional to the additive concentration.

TABLE 7

Statistical Evaluation of FTIR replicate Spectra: 1,440/1,600 $cm^{-1}$

| | day 1 data | | | day 2 data | | | | |
|---|---|---|---|---|---|---|---|---|
| | Parent Coal | 1/2 addit 0.0 HES | 1/2 addit. 1.5 HES | Parent Coal II | 3/8 addit 1.0 HES | 1/2 addit 1.0 HES | 3/8 addit 1.25 HES | 1/2 addit 1.25 HES |
| Mean | 0.477 | 0.693 | 0.670 | 0.474 | 0.588 | 0.678 | 0.603 | 0.698 |
| std dev | 0.018 | 0.052 | 0.030 | 0.012 | 0.039 | 0.031 | 0.014 | 0.032 |
| % rsd | 3.8 | 7.5 | 4.4 | 2.6 | 6.6 | 4.6 | 2.3 | 4.6 |
| n | 6 | 5 | 5 | 5 | 5 | 5 | 6 | 5 |
| deg freedom | 5 | 4 | 4 | 4 | 4 | 4 | 5 | 4 |
| t-calc | | 9.64 | 13.3 | | 6.245 | 13.62 | 16.09 | 14.49 |
| t-table (95%) | | 2.26 | 2.26 | | 1.86 | 1.86 | 1.83 | 1.86 |
| t-table (99%) | | 3.25 | 3.25 | | 2.31 | 2.31 | 2.26 | 2.31 |

Figure 14:
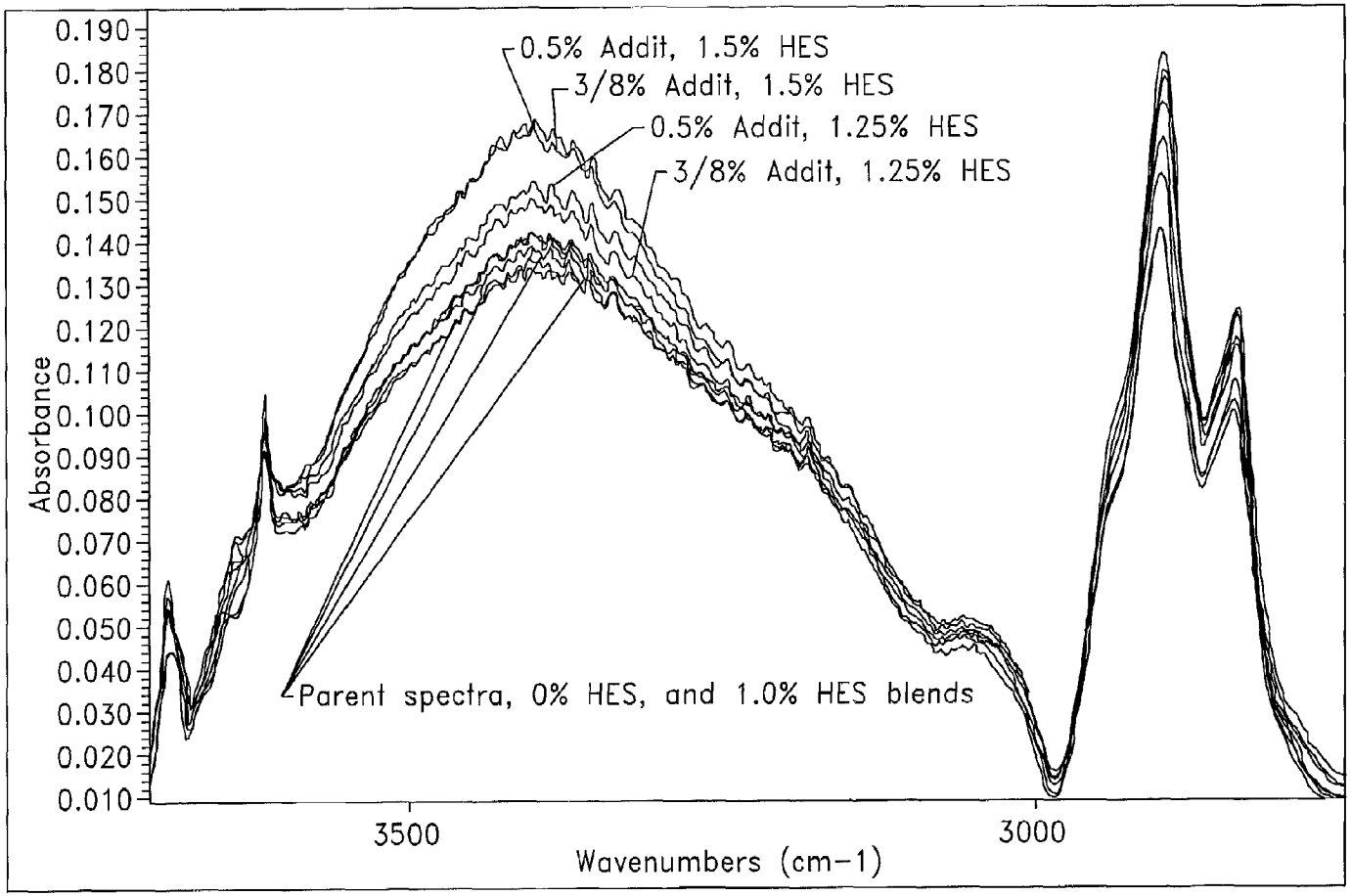
FIG. 14 is an FTIR spectral comparison of synthetic fuel starting materials to the synthetic fuel of FIG. 12 demonstrating chemical change at approximately 3420 $cm^{-1}$.

FIG. 14 demonstrates absorption in the FTIR spectra in the H-bonding region. Again, a clear correlation can be observed between the magnitude of absorption and the concentration of HES binder and/or chemical change additive. However, unlike the prior two figures in which the observed changes appeared to correlate more directly with the level of additive in a given blend with a lesser enhancement attributed to the concentration of HES, the increase in absorption shown in FIG. 14 appears to be governed more by the concentrations of HES with a lesser level of enhancement attributed to higher concentrations of chemical change additive. The replicate spectra that were used to generate the average spectra plotted in FIG. 14 were subjected to a statistical evaluation with the results from that evaluation shown in Table 8. The data in this table indicate that the increase in absorption was significant with greater than 95 percent confidence for the two blends containing 1.5 percent HES. As for the two blends containing 1.25 percent HES, the statistical evaluation indicates that the increase in absorption was significant for the sample containing 0.5 percent chemical change additive, and was not significant in 95 percent confidence for the blend containing 0.375 percent chemical change additive. These statistical results support the contention that this particular change in chemical bonding can be attributed primarily to the concentration of HES binder but is enhanced by increasing concentrations of chemical change additive. It should also be noted that while the increase in H-bonding was not found to be significant at the 95 percent confidence level for a 0.375 percent additive/1.25 percent HES blend, there is an observable increase in average magnitude of absorption for this blend relative to the parent coal spectra. Based on the spectra in FIG. 14 and the statistical data in Table 8, it is believed that additional replicate runs would have resulted in a positive finding of a statistically significant change in H-bonding for the 0.375 percent chemical change additive/1.25 percent HES blend.

TABLE 8

Statistical evaluation of FTIR replicate spectra: 3,440 $cm^{-1}$ band.

| | day 1 data | | | day 2 data | | | | |
|---|---|---|---|---|---|---|---|---|
| | Parent Coal | 1/2 addit 0.0 HES | 1/2 addit. 1.5 HES | Parent Coal II | 3/8 addit 1.0 HES | 1/2 addit 1.0 HES | 3/8 addit 1.25 HES | 1/2 addit 1.25 HES |
| Mean | 0.133 | 0.137 | 0.161 | 0.1242 | 0.1248 | 0.1278 | 0.1418 | 0.1422 |
| std dev | 0.020 | 0.017 | 0.020 | 0.0107 | 0.0144 | 0.0103 | 0.0213 | 0.0123 |
| % rsd | 15.0 | 12.7 | 12.5 | 8.6 | 11.6 | 8.1 | 15.0 | 8.7 |
| n | 6 | 5 | 5 | 5 | 5 | 5 | 6 | 5 |
| deg freedom | 5 | 4 | 4 | 4 | 4 | 4 | 5 | 4 |
| t-calc | | 0.32 | 2.31 | | 0.08 | 0.54 | 1.67 | 2.47 |
| t-table (95%) | | 2.26 | 2.26 | | 2.31 | 2.31 | 2.26 | 2.31 |
| t-table (99%) | | 3.25 | 3.25 | | 3.36 | 3.36 | 3.25 | 3.36 |

In summary, the results presented in FIGS. 12 through 14, coupled with the statistical evaluations in Tables 7 and 8, clearly show that multiple, significant changes occurred in the molecular bonding of the starting components during or shortly after blending. Further, each of these observed change in the chemical bonding appears to have been impacted by the concentration of both the chemical change additive and the HES binder, thereby indicating a synergistic effect between these two materials with respect to reactivity. In addition, the spectra presented in both the preceding examples as well as these examples provide evidence that the coal/binder/chemical change additive blends continue to react with it in time. Finally, the changes in chemical bonding as illustrated by the increases in absorption at 875 $cm^{-1}$ and 1440 $cm^{-1}$, shown in FIGS. 12 and 13, are clearly significant, even in the absence of the HES binder. However, the increase in H-bonding shown in FIG. 14 serves to strengthen the argument for a significant change in chemical bonding considering the relatively high abundance of hydroxyl groups present in bituminous coals which are available as well as likely to participate in such reactions.

Example 11

Medium sulfur blend coal of Kentucky is blended with a 25 percent solution of $Ca(OH)_2$ to generate five synthetic fuels, each having concentrations of 0.2, 0.75, 1.0, 5.0 percent and 10 percent chemical additive by-weight coal respectively. Each coal chemical solution is mixed in a Hobart lab mixer to assure uniform mixing, and the coal is allowed to react to absorb carbon dioxide from the air by placing the mixture on a steel table overnight. Fusion temperature of the ash from the coal before treatment and after chemical treatment is performed according to ASTM Method D1857. The fusion temperatures of the 0.2, 0.75, 1.0, 5.0 and 10 percent synthetic fuels is compared with a control coal sample. The results of this analysis are shown in Table 9 below.

TABLE 9

Expected Fusion Temperature Differences Between Treated and Untreated Coal

| | INITIAL DEFORMATION DIFFERENCE (ITD) | SOFTENING TEMPERATURE DIFFERENCE (STD) | HEMISPHERIC TEMPERATURE DIFFERENCE (HTD) | FLUID TEMPERATURE DIFFERENCE (FTD) |
|---|---|---|---|---|
| 0.2% $Ca(OH)_2$ | INSIGNIFICANT REDUCTION | INSIGNIFICANT REDUCTION | INSIGNIFICANT REDUCTION | INSIGNIFICANT REDUCTION |
| 0.75% $Ca(OH)_2$ | INSIGNIFICANT REDUCTION | INSIGNIFICANT REDUCTION | INSIGNIFICANT REDUCTION | INSIGNIFICANT REDUCTION |
| 1.0% $Ca(OH)_2$ | INSIGNIFICANT REDUCTION | INSIGNIFICANT REDUCTION | INSIGNIFICANT REDUCTION | INSIGNIFICANT REDUCTION |
| 5.0% $Ca(OH)_2$ | SIGNIFICANT REDUCTION | SIGNIFICANT REDUCTION | SIGNIFICANT REDUCTION | SIGNIFICANT REDUCTION |
| 10.0% $Ca(OH)_2$ | SIGNIFICANT REDUCTION | SIGNIFICANT REDUCTION | SIGNIFICANT REDUCTION | SIGNIFICANT REDUCTION |

As Table 9 depicts, the samples with the high concentrations of chemical change additive (5.0 and 10.0 percent) are expected to show a significant decrease in fusion temperature while the samples with chemical change additive according to the present invention are expected to show insignificant reduction in fusion temperature.

As Table 10 depicts, the samples with the high concentrations of chemical change additive (5.0 and 10.0 percent) are expected to show a significant decrease in fusion temperature while the samples with chemical change additive according to the present invention are expected to show insignificant reduction in fusion temperature.

Example 12

Medium sulfur blend coal of Kentucky is blended with a 25 percent solution of $Mg(OH)_2$ to generate five synthetic fuels, each having concentrations of 0.2, 0.75, 1.0, 5.0 percent and 10 percent chemical additive by-weight coal respectively. Each coal chemical solution is mixed in a Hobart lab mixer to assure uniform mixing, and the coal is allowed to react to absorb carbon dioxide from the air by placing the mixture on a steel table overnight. Fusion temperature of the ash from the coal before treatment and after chemical treatment is performed according to ASTM Method D1857. The fusion temperatures of the 0.2, 0.75, 1.0, 5.0 and 10 percent synthetic fuels is compared with a control coal sample. The expected results of this analysis are shown in Table 10 below.

Example 13

Medium sulfur blend coal is blended with a 25 percent solution of dolomitic lime solution (14 percent Mg) to prepare five concentrations of synthetic fuel, 0.2, 0.75, 1.0, 5.0 percent and 10 percent chemical additive by-weight coal. Each coal chemical solution is mixed in a Hobart lab mixer to assure uniform mixing, and the coal is allowed to react to absorb carbon dioxide from the air by placing the mixture on a steel table overnight. Fusion temperature of the ash from the coal before treatment and after chemical treatment is performed according to ASTM Method D1857. The fusion temperatures of the 0.2, 0.75, 1.0, 5.0 and 10 percent synthetic fuels is compared with a control coal sample. The expected results of this analysis are shown in Table 11 below.

TABLE 10

| | Expected Fusion Temperature Differences Between Treated and Untreated Coal | | | |
|---|---|---|---|---|
| | INITIAL DEFORMATION DIFFERENCE (ITD) | SOFTENING TEMPERATURE DIFFERENCE (STD) | HEMISPHERIC TEMPERATURE DIFFERENCE (HTD) | FLUID TEMPERATURE DIFFERENCE (FTD) |
| 0.2% $Mg(OH)_2$ | INSIGNIFICANT REDUCTION | INSIGNIFICANT REDUCTION | INSIGNIFICANT REDUCTION | INSIGNIFICANT REDUCTION |
| 0.75% $Mg(OH)_2$ | INSIGNIFICANT REDUCTION | INSIGNIFICANT REDUCTION | INSIGNIFICANT REDUCTION | INSIGNIFICANT REDUCTION |
| 1.0% $Mg(OH)_2$ | INSIGNIFICANT REDUCTION | INSIGNIFICANT REDUCTION | INSIGNIFICANT REDUCTION | INSIGNIFICANT REDUCTION |
| 5.0% $Mg(OH)_2$ | SIGNIFICANT REDUCTION | SIGNIFICANT REDUCTION | SIGNIFICANT REDUCTION | SIGNIFICANT REDUCTION |
| 10.0% $Mg(OH)_2$ | SIGNIFICANT REDUCTION | SIGNIFICANT REDUCTION | SIGNIFICANT REDUCTION | SIGNIFICANT REDUCTION |

TABLE 11

| | Expected Fusion Temperature Differences Between Treated and Untreated Coal | | | |
|---|---|---|---|---|
| | INITIAL DEFORMATION DIFFERENCE (ITD) | SOFTENING TEMPERATURE DIFFERENCE (STD) | HEMISPHERIC TEMPERATURE DIFFERENCE (HTD) | FLUID TEMPERATURE DIFFERENCE (FTD) |
| 0.2% Dolomite | INSIGNIFICANT REDUCTION | INSIGNIFICANT REDUCTION | INSIGNIFICANT REDUCTION | INSIGNIFICANT REDUCTION |
| 0.75% Dolomite | INSIGNIFICANT REDUCTION | INSIGNIFICANT REDUCTION | INSIGNIFICANT REDUCTION | INSIGNIFICANT REDUCTION |
| 1.0% Dolomite | INSIGNIFICANT REDUCTION | INSIGNIFICANT REDUCTION | INSIGNIFICANT REDUCTION | INSIGNIFICANT REDUCTION |
| 5.0% Dolomite | SIGNIFICANT REDUCTION | SIGNIFICANT REDUCTION | SIGNIFICANT REDUCTION | SIGNIFICANT REDUCTION |
| 10.0% Dolomite | SIGNIFICANT REDUCTION | SIGNIFICANT REDUCTION | SIGNIFICANT REDUCTION | SIGNIFICANT REDUCTION |

As Table 11 depicts, the samples with the high concentrations of chemical change additive (5.0 and 10.0 percent) are expected to show a significant decrease in fusion temperature while the samples with chemical change additive according to the present invention are expected to show insignificant reduction in fusion temperature.

Example 14

Synthetic fuel of the present invention having 0.2 percent chemical change additive was prepared as described in example 6 above in the following proportions: a combination of 95.5 parts coal, 1.5 parts HES, 0.2 parts dry chemical $Ca(OH)_2$ change additive, and 2.8 parts water in a synthetic fuel plant. The synthetic fuel was analyzed by FTIR according to the parameters of example 6.

The spectra obtained was equivalent to those demonstrated in FIGS. 6 and 7. The spectra show the presence of an absorption band in the synfuel and control blend that is absent in the spectra of the starting components (parent coal, HES, and calcium oxide additive). Due to the nature of absorption of infrared radiation, appearance of the 875 $cm^{-1}$ band provides unambiguous evidence of the presence of a newly formed chemical bond in the synthetic fuel and control blend that is not present in any of the starting components.

The spectra equivalent to that shown in FIG. 7 highlight a second change that was detected in the chemical bonding of the synfuel and control samples. Absorption at 1440 $cm^{-1}$ is generally attributed to aliphatic C—C bonds or to $CO_3$ functional groups. The calcium oxide additive spectrum does not exhibit an absorption band in this region, but the HES binder does exhibit an absorption band nearby at 1460 $cm^{-1}$.

A third change in the absorption of infrared radiation equivalent to that shown in FIG. 8, was not observed.

Example 15

Synthetic fuel of the present invention having 0.75 and 1.0 percent $Ca(OH)_2$ chemical change additive is prepared as described in example 6 above in the following proportions: 1) 0.75 percent—a combination of 95.5 parts coal, 1.5 parts HES, 0.75 parts dry chemical change additive, and 2.25 parts water; and 2) 1.0 percent—a combination of 95.5 parts coal, 1.5 parts HES, 1.0 parts dry chemical change additive, and 2.0 parts water. The synthetic fuel is analyzed by FTIR according to the parameters of example 6.

The spectra obtained is equivalent to those demonstrated in FIGS. 6 and 7. The spectra show the presence of an absorption band in the synfuel and control blend that is absent in the spectra of the starting components (parent coal, HES, and calcium oxide additive). Due to the nature of absorption of infrared radiation, appearance of the 875 $cm^{-1}$ band provides unambiguous evidence of the presence of a newly formed chemical bond in the synthetic fuel and control blend that is not present in any of the starting components.

The spectra equivalent to that shown in FIG. 7 highlight a second change that is detected in the chemical bonding of the synfuel and control samples. Absorption at 1440 $cm^{-1}$ is generally attributed to aliphatic C—C bonds or to $CO_3$ functional groups. The calcium oxide additive spectrum does not exhibit an absorption band in this region, but the HES binder does exhibit an absorption band nearby at 1460 $cm^{-1}$.

A third change in the absorption of infrared radiation equivalent to that shown in FIG. 8, is observed that demonstrated a complete chemical change.

Example 16

Synthetic fuel of the present invention having 0.2 0.75 and 1.0 percent $Mg(OH)_2$ chemical change additive is prepared as described in example 6 above in the following proportions: 1) 0.2 percent—a combination of 95.5 parts coal, 1.5 parts HES, 0.2 parts dry chemical change additive, and 2.8 parts water; 2) 0.75 percent—a combination of 95.5 parts coal, 1.5 parts HES, 0.75 parts dry chemical change additive, and 2.25 parts water; and 3) 1.0 percent—a combination of 95.5 parts coal, 1.5 parts HES, 1.0 parts dry chemical change additive, and 2.0 parts water. The synthetic fuel is analyzed by FTIR according to the parameters of example 6.

The spectra obtained is equivalent to those demonstrated in FIGS. 6 and 7. The spectra show the presence of an absorption band in the synfuel and control blend that is absent in the spectra of the starting components (parent coal, HES, and magnesium hydroxide additive). Due to the nature of absorption of infrared radiation, appearance of the 875 $cm^{-1}$ band provides unambiguous evidence of the presence of a newly formed chemical bond in the synthetic fuel and control blend that is not present in any of the starting components.

The spectra equivalent to that shown in FIG. 7 highlight a second change that is detected in the chemical bonding of the synfuel and control samples. Absorption at 1440 $cm^{-1}$ is generally attributed to aliphatic C—C bonds or to $CO_3$ functional groups. The magnesium oxide additive spectrum does not exhibit an absorption band in this region, but the HES binder does exhibit an absorption band nearby at 1460 $cm^{-1}$.

A third change in the absorption of infrared radiation equivalent to that shown in FIG. 8, is observed that demonstrated a complete chemical change.

Example 17

Synthetic fuel of the present invention having 0.75 and 1.0 percent hydroxides of dolomite chemical change additive is prepared as described in example 6 above in the following proportions: 1) 0.2 percent—a combination of 95.5 parts coal, 1.5 parts HES, 0.2 parts dry chemical change additive, and 2.8 parts water; 2) 0.75 percent—a combination of 95.5 parts coal, 1.5 parts HES, 0.75 parts dry chemical change additive, and 2.25 parts water; and 3) 1.0 percent—a combination of 95.5 parts coal, 1.5 parts HES, 1.0 parts dry chemical change additive, and 2.0 parts water. The synthetic fuel is analyzed by FTIR according to the parameters of example 6.

The spectra obtained is equivalent to those demonstrated in FIGS. 6 and 7. The spectra show the presence of an absorption band in the synfuel and control blend that is absent in the spectra of the starting components (parent coal, HES, and hydroxides of dolomite additive). Due to the nature of absorption of infrared radiation, appearance of the 875 $cm^{-1}$ band provides unambiguous evidence of the presence of a newly formed chemical bond in the synthetic fuel and control blend that is not present in any of the starting components.

The spectra equivalent to that shown in FIG. 7 highlight a second change that is detected in the chemical bonding of the synfuel and control samples. Absorption at 1440 $cm^{-1}$ is generally attributed to aliphatic C—C bonds or to $CO_3$ functional groups. The hydroxides of dolomite additive spectrum does not exhibit an absorption band in this region, but the HES binder does exhibit an absorption band nearby at 1460 $cm^{-1}$.

A third change in the absorption of infrared radiation equivalent to that shown in FIG. 8, is observed that demonstrated a complete chemical change.

While it has been established that the present invention provides synthetic fuel exhibiting a measurable chemical change, the present invention also increases efficiency at power plants. Again, because low levels of chemical additive are used, the fusion temperature of the power plant's burner is not lowered to the extent that slag builds up and the burner needs to be shut down for cleaning. Moreover, the use of low level chemical change additives allows for the use of low levels of hydrocarbons to further cause chemical change while at the same time increasing BTU value. By allowing for the use of low levels of hydrocarbon to cause chemical change the burner and power plant equipment do not become fouled. Therefore, another advantage is the decrease of plant down time.

Additional objects, advantages and other novel features of the invention will become apparent to those skilled in the art upon examination of the foregoing or may be learned with practice of the invention. The foregoing description of preferred embodiments of the invention has been presented for purposes of illustration and description. It is not intended to be exhaustive or to limit the invention to the precise form disclosed. Obvious modifications or variations are possible in light of the above teachings. The embodiments were chosen and described to provide the best illustrations of the principles of the invention and their practical application, thereby enabling one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A method for preparing synthetic fuel, consisting essentially of:

mixing a chemical change additive with a solid fuel material by spraying said chemical change additive onto the solid fuel material, the chemical change additive including about 75 to about 95 percent water and being present in an amount of less than about 1 percent by-weight of the synthetic fuel and selected from the group consisting of alkaline earth oxides alkaline earth hydroxides and mixtures thereof, said chemical change additive being effective in converting the solid fuel material into a synthetic fuel; and adding molasses in an amount between about 0.25 and 1.6 percent by-weight of said synthetic fuel and not briquetting the synthetic fuel.

2. A synthetic fuel composition, consisting essentially of:

a solid fuel material;

a chemical change additive present in an amount of between about 0.1 and about 1.0 percent by-weight of the synthetic fuel composition and selected from the group consisting of alkaline earth oxides alkaline earth hydroxides and mixtures thereof, said chemical change additive being effective in converting the solid fuel material into a synthetic fuel; and carbon dioxide;

wherein the composition further comprises molasses in an amount between about 0.5 and 1.5 percent by-weight of said synthetic fuel.

3. The composition of claim 2 wherein said solid fuel material is selected from the group consisting of hydrocarbons, hydrocarbon mixtures, emulsifications of hydrocarbons or hydrocarbon mixtures, and mixtures thereof.

4. The composition of claim 2 wherein said chemical change additive is selected from the group consisting of calcium oxide, calcium hydroxide, magnesium oxide, magnesium hydroxide, oxides of dolomite, hydroxides of dolomite and mixtures thereof.

5. A solid synthetic fuel composition, consisting essentially of:

a combustible material including coal and from about 1 to about 60 percent biomass; and a chemical change additive present in an amount of less than 1 percent by-weight of the synthetic fuel and selected from the group consisting of alkaline earth oxides, alkaline earth hydroxides and mixtures thereof, said chemical change additive being effective in converting the combustible material into a synthetic fuel.

6. The method of claim 1 wherein said molasses is present in an amount between 0.5 and 1.5 percent by-weight of said synthetic fuel.

7. The composition of claim 2 wherein the chemical change additive is an alkaline earth hydroxide.

8. A method for preparing synthetic fuel, consisting essentially of:

mixing a first chemical change additive with a solid fuel material by spraying said first chemical change additive onto the solid fuel material, the chemical change additive including about 75 to about 95 percent water and being present in an amount of less than about 1 percent by-weight of the synthetic fuel and selected from the group consisting of alkaline earth oxides, alkaline earth hydroxides and mixtures thereof, said chemical change additive being effective in converting the solid fuel material into a synthetic fuel;

adding a second chemical change additive, the second chemical change additive selected from the group consisting of asphalt, tall oil, liquid hydrocarbon, and combinations thereof, and emulsifications thereof and present in an amount of less than about 3.0 percent by-weight of said synthetic fuel;

allowing the synthetic fuel to cure at ambient pressure and temperature; and exposing the synthetic fuel to carbon dioxide.

9. The method of claim 8 wherein said second chemical change additive is present in an amount between 0.5 and 1.5 percent by-weight of said synthetic fuel.

10. The method of claim 8 wherein said second chemical change additive is present in an amount between approximately 0.25 and 1.5 percent by-weight of said synthetic fuel.

11. The method of claim 8 wherein said second chemical change additive is present in an amount between approximately 0.375 and 1.22 percent by-weight of said synthetic fuel.

12. A solid synthetic fuel composition, consisting essentially of:

a combustible material including coal and from about 1 to about 60 percent biomass;

a first chemical change additive present in an amount of less than 1 percent by-weight of the synthetic fuel and selected from the group consisting of alkaline earth oxides, alkaline earth hydroxides and mixtures thereof, said chemical change additive being effective in converting the combustible material into a synthetic fuel; and a second chemical change additive consisting of tall oil, asphalt, emulsifications thereof or combinations thereof.

* * * * *